US008474929B2

(12) United States Patent
Kikkawa et al.

(10) Patent No.: US 8,474,929 B2
(45) Date of Patent: Jul. 2, 2013

(54) IMAGE FORMING APPARATUS

(75) Inventors: Fumitaka Kikkawa, Kanagawa (JP); Tomomi Katoh, Kanagawa (JP); Toshiroh Tokuno, Tokyo (JP); Jun Ichinowatari, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 395 days.

(21) Appl. No.: 12/959,918

(22) Filed: Dec. 3, 2010

(65) Prior Publication Data

US 2011/0141167 A1 Jun. 16, 2011

(30) Foreign Application Priority Data

Dec. 15, 2009 (JP) ..... 2009-284565

(51) Int. Cl.
*B41J 29/38* (2006.01)
*B41J 2/175* (2006.01)

(52) U.S. Cl.
USPC ..... 347/6; 347/85

(58) Field of Classification Search
USPC ..... 347/89, 7, 85, 6
See application file for complete search history.

(56) References Cited

U.S. PATENT DOCUMENTS

| | | | | |
|---|---|---|---|---|
| 4,399,446 | A * | 8/1983 | McCann et al. | 347/89 |
| 4,714,931 | A * | 12/1987 | Erskine et al. | 347/7 |
| 4,827,278 | A * | 5/1989 | Lecheheb | 347/7 |
| 5,331,339 | A * | 7/1994 | Takahashi | 347/89 |
| 5,446,486 | A | 8/1995 | Reis | |
| 5,943,078 | A * | 8/1999 | Nishimoto et al. | 347/89 |
| 7,325,908 | B2 | 2/2008 | Katoh et al. | |
| 7,540,598 | B2 | 6/2009 | Hori et al. | |
| 2005/0073559 | A1 | 4/2005 | Aruga et al. | |
| 2006/0132554 | A1 * | 6/2006 | Ota et al. | 347/85 |
| 2007/0291086 | A1 * | 12/2007 | Murakami et al. | 347/85 |
| 2008/0273046 | A1 | 11/2008 | Ishinaga et al. | |
| 2009/0290002 | A1 | 11/2009 | Katoh | |
| 2010/0214378 | A1 * | 8/2010 | Katoh et al. | 347/85 |
| 2011/0050816 | A1 * | 3/2011 | Katoh et al. | 347/85 |
| 2011/0164078 | A1 * | 7/2011 | Katoh et al. | 347/6 |

FOREIGN PATENT DOCUMENTS

| | | |
|---|---|---|
| JP | 5-504308 | 7/1993 |
| JP | 3606282 | 10/2004 |
| JP | 2004-351845 | 12/2004 |
| JP | 2005-342960 | 12/2005 |

* cited by examiner

*Primary Examiner* — Stephen Meier
*Assistant Examiner* — Carlos A Martinez
(74) *Attorney, Agent, or Firm* — Cooper & Dunham LLP

(57) ABSTRACT

An image forming apparatus includes a first path through which liquid is supplied to a recording head; a second path connected to a liquid tank; a pressure-adjustment valve connecting the first path with the second path, wherein resistance inside the pressure-adjustment valve changes according to a flow rate of the liquid flowing through the first path; a third path connecting the second path with the pressure-adjustment valve, wherein the third path includes a pump; a fourth path that connects the recording head with the liquid tank and bypasses the pressure-adjustment valve; and an opening/closing valve that opens/closes the fourth path. When an environmental temperature exceeds a threshold, liquid is supplied to the recording head by operating the pump and opening the fourth path. When the environmental temperature is less than the threshold, liquid is supplied to the recording head by operating the pump and closing the fourth path.

7 Claims, 18 Drawing Sheets

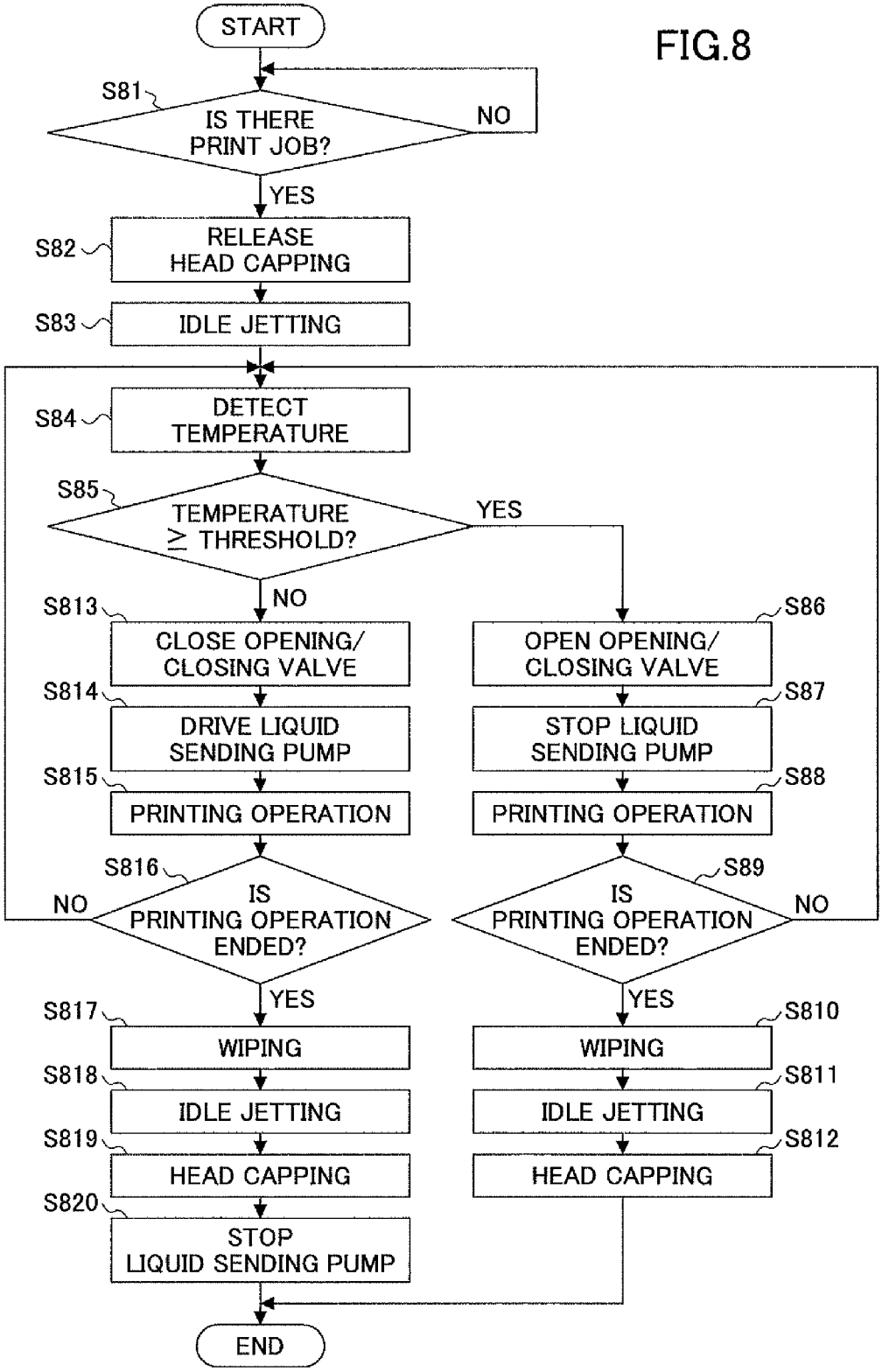
FIG.8
START
S81
IS THERE PRINT JOB?
NO
YES
S82
RELEASE HEAD CAPPING
S83
IDLE JETTING
S84
DETECT TEMPERATURE
S85
TEMPERATURE ≥ THRESHOLD?
YES
NO
S813
CLOSE OPENING/ CLOSING VALVE
S814
DRIVE LIQUID SENDING PUMP
S815
PRINTING OPERATION
S816
IS PRINTING OPERATION ENDED?
NO
YES
S817
WIPING
S818
IDLE JETTING
S819
HEAD CAPPING
S820
STOP LIQUID SENDING PUMP
S86
OPEN OPENING/ CLOSING VALVE
S87
STOP LIQUID SENDING PUMP
S88
PRINTING OPERATION
S89
IS PRINTING OPERATION ENDED?
NO
YES
S810
WIPING
S811
IDLE JETTING
S812
HEAD CAPPING
END

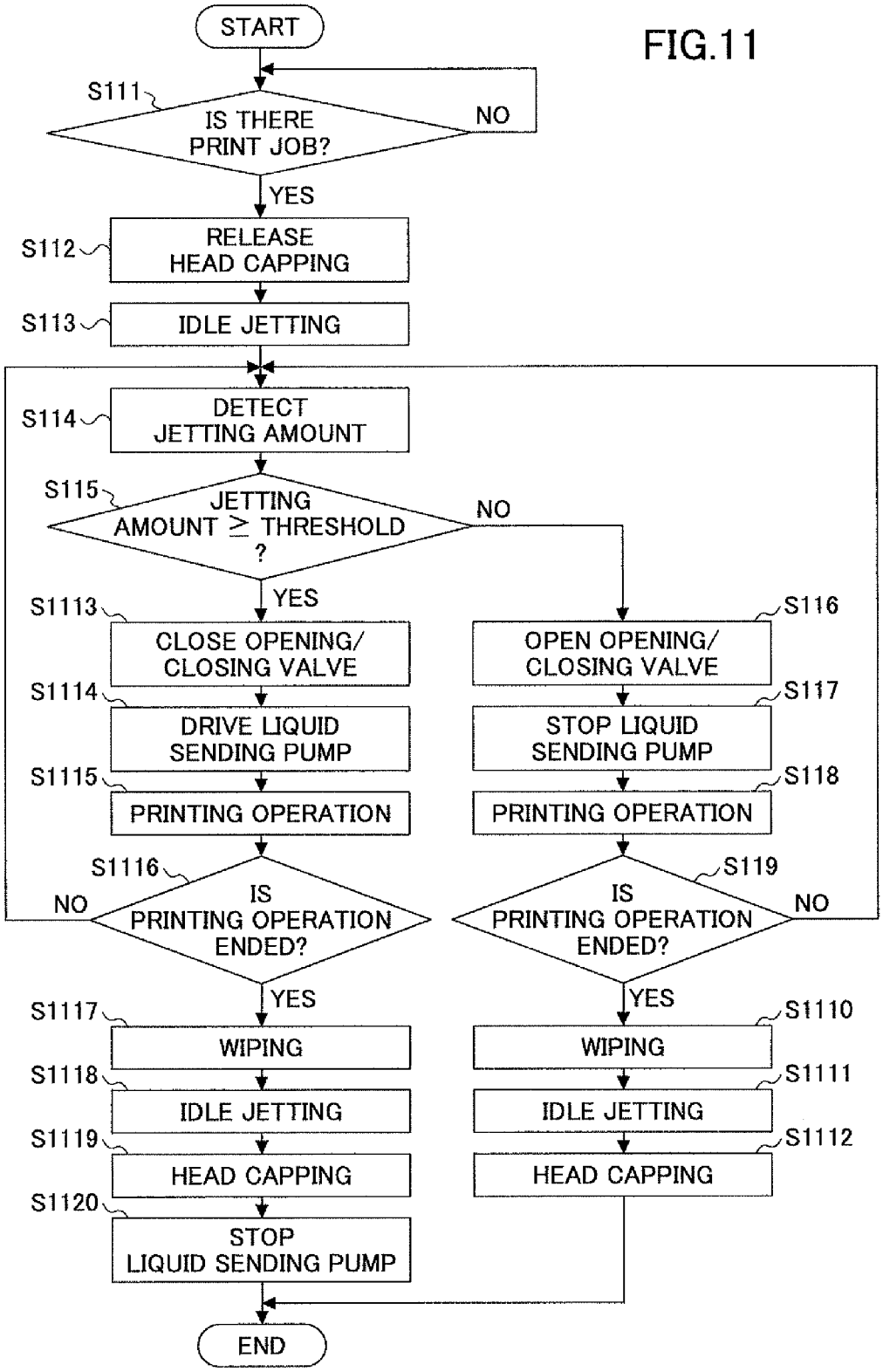
FIG.11
START
S111
IS THERE PRINT JOB?
NO
YES
S112
RELEASE HEAD CAPPING
S113
IDLE JETTING
S114
DETECT JETTING AMOUNT
S115
JETTING AMOUNT ≥ THRESHOLD ?
NO
YES
S1113
CLOSE OPENING/ CLOSING VALVE
S1114
DRIVE LIQUID SENDING PUMP
S1115
PRINTING OPERATION
S1116
IS PRINTING OPERATION ENDED?
NO
YES
S1117
WIPING
S1118
IDLE JETTING
S1119
HEAD CAPPING
S1120
STOP LIQUID SENDING PUMP
S116
OPEN OPENING/ CLOSING VALVE
S117
STOP LIQUID SENDING PUMP
S118
PRINTING OPERATION
S119
IS PRINTING OPERATION ENDED?
NO
YES
S1110
WIPING
S1111
IDLE JETTING
S1112
HEAD CAPPING
END

IMAGE FORMING APPARATUS

BACKGROUND OF THE INVENTION

1. Field of the Invention

The present invention relates to image forming apparatuses, and more particularly to an image forming apparatus including a recording head for jetting liquid droplets.

2. Description of the Related Art

There are image forming apparatuses such as printers, fax machines, copiers, plotters, and multifunction peripherals including these functions. An inkjet recording device is known as an example of a liquid jet recording type image forming apparatus including a recording head for jetting ink droplets. A liquid jet recording type image forming apparatus jets ink droplets from a recording head onto a sheet that is being conveyed, for forming images (recording, printing, etc., are also used as synonyms of forming). There are serial type image forming apparatuses for forming images by jetting liquid droplets while moving the recording head in the main scanning direction. There are also line type image forming apparatuses using line type heads for forming images by jetting liquid droplets without moving the recording head.

In the present application, an image forming apparatus is an apparatus for forming images by jetting ink onto media such as paper, threads, fiber, cloth, leather, metal plastic, glass, timber, and ceramics (also including a simple liquid jetting device). Forming images does not only mean to form images having meaning such as characters and figures onto media, but also means forming images without any meaning such as patterns onto media (including liquid jetting devices that simply jet liquid droplets onto media). In the present application, ink is not limited to ink per se, but ink is a collective term of all kinds of liquid with which images can be formed, including recording liquid, fixing-processing liquid, liquid DNA samples, and patterning materials. In the present application, a sheet may be a sheet other than a paper sheet, such as an OHP sheet or cloth; a sheet is a collective term of all kinds of sheets to which ink droplets can adhere, including a recording medium, a recording sheet, etc. An image is not limited to a planar image; an image may be three-dimensionally formed on the sheet, or a three-dimensional object may be formed on the sheet.

Examples of known liquid jetting heads used as recording heads include the following. One example is a piezoelectric type head that jets liquid droplets by using a piezoelectric actuator to change the position of an oscillating plate so that the volume in the liquid chamber is changed and the pressure is increased. Another example is a thermal type head that jets liquid droplets by increasing the pressure in the liquid chamber with bubbles that are caused by heat generated by a heating element, which is heated by electric currents applied inside the liquid chamber.

For such a liquid jet recording type image forming apparatus, there is demand for increasing image formation throughput, i.e., for increasing the speed of image formation. Accordingly, in the image forming apparatus, ink is supplied from a high-volume ink cartridge (main tank) that is set in the main unit of the image forming apparatus, to a sub tank (or buffer tank) above the recording head, through a tube. By using this method of supplying ink through a tube (tube supplying method), the carriage part can be made lightweight and compact, so that the size of the apparatus can be significantly reduced, both in terms of the structure and the driving system.

In the tube supplying method, the ink that is consumed for forming images with the recording head is supplied to the recording head from the ink cartridge through a tube. If this tube is a thin tube that is highly flexible, the fluid resistance is high when the ink flows through the tube. Consequently, the ink may not be properly supplied in time for jetting ink, and jetting failures may occur (also referred to as refill failures). Particularly, in a large size machine used for printing images onto wide recording media, the tube is inevitably long, and therefore the fluid resistance is high. Furthermore, when high-speed printing is performed, or when highly viscous ink is used, the fluid resistance is high, and the ink may not be properly supplied to the recording head.

Conventionally, there is known a method as disclosed in patent document 1. Specifically, pressure application on the ink in the ink cartridge is maintained, and a differential pressure regulating valve is provided on the upstream side of the path for supplying ink to the recording head. Accordingly, the ink is supplied when the negative pressure in the sub tank becomes higher than a predetermined value.

Furthermore, there is known a method as disclosed in patent document 2. Specifically, a negative pressure chamber that achieves negative pressure with the use of a spring is provided on the upstream side of the recording head. The ink supplying pressure is actively controlled by sending ink to the negative pressure chamber with the use of a pump. In a method as disclosed in patent document 3, the ink supplying pressure is also controlled with the use of a pump, although in this case there is no negative pressure chamber.

Meanwhile, there is also a method of achieving negative pressure with a simple structure. Specifically, an ink cartridge connected to the atmosphere and a recording head are connected by a tube. Simply by positioning the ink cartridge below the recording head, negative pressure is achieved by the water head difference.

This water head difference method is far more simple than the method of constantly applying pressure with the use of a valve coupled with negative pressure or the method of providing a negative pressure chamber and sending liquid to the negative pressure chamber with the use of a pump. Nevertheless, negative pressure can be stably achieved with the water head difference method. However, the problem with the water head difference method is that pressure loss may be caused by the resistance in the tube as described above.

Patent document 4 discloses a technology for solving the problem of pressure loss of an ink supplying system in which negative pressure is achieved according to the water head difference. Specifically, a pump is provided in the tube connecting the recording head and the ink cartridge. A bypass path is provided for connecting the upstream side and the downstream side of the pump. A valve is provided in the bypass path. The degree of opening the valve in the bypass path is appropriately controlled in accordance with the printing operation to maintain an appropriate level of pressure.

Patent Document 1: Japanese Patent No. 3606282

Patent Document 2: Japanese Laid-Open Patent Application No. 2005-342960

Patent Document 3: Japanese National Publication (Japanese translation of PCT application) No. H5-504308

Patent Document 4: Japanese Laid-Open Patent Application No. 2004-351845

However, although the technology disclosed in patent document 1 solves the problem of refill failures as described above, the mechanism for controlling the negative pressure is complex. Furthermore, the valve coupled with negative pressure needs to have good sealing properties. Furthermore, pressure is constantly applied in this method, and therefore all of the connection parts in the ink supplying path need to be highly airtight. Thus, in the event of a failure in the system, the ink may blow out.

In the technologies disclosed in patent documents 2 and 3, the pressure is actively controlled with the use of a pump, and therefore the amount of liquid conveyed by the pump needs to be accurately controlled in accordance with the consumption amount of ink. Therefore, it is necessary to perform feedback control with the pressure in the negative pressure chamber. Furthermore, when these technologies are applied to an image forming apparatus in which plural ink types of different colors are used, the pump needs to be controlled according to the different colors. Therefore, complex control operations and a large-sized apparatus are required.

In the technology disclosed in patent document 4, when this technology is applied to an image forming apparatus in which plural ink types of different colors are used, the pump needs to be controlled according to the different colors. Therefore, a large-sized apparatus is required.

SUMMARY OF THE INVENTION

The present invention provides an image forming apparatus in which one or more of the above-described disadvantages are eliminated.

A preferred embodiment of the present invention provides an image forming apparatus in which an appropriate level of negative pressure can be maintained without causing refill failures and energy efficiency can be increased by driving the liquid sending unit in an efficient manner, with a simple structure and simple control operations.

According to an aspect of the present invention, there is provided an image forming apparatus including a recording head including a nozzle that jets liquid droplets; a liquid tank that retains liquid to be supplied to the recording head; a first flow path through which the liquid is supplied to the recording head; a second flow path connected to the liquid tank; a pressure adjustment valve connecting the first flow path with the second flow path, wherein a flow path resistance inside the pressure adjustment valve changes in accordance with a flow rate of the liquid flowing through the first flow path; a third flow path connecting the second flow path or the liquid tank with the pressure adjustment valve; a liquid sending unit that performs a liquid sending operation, the liquid sending unit being provided in the third flow path; a fourth flow path that connects the recording head with the liquid tank and bypasses the pressure adjustment valve; a flow path opening/closing valve that performs an opening/closing operation for opening and closing the fourth flow path; a temperature detecting unit that detects an environmental temperature of the image forming apparatus; and a control unit that controls the opening/closing operation performed by the flow path opening/closing valve and the liquid sending operation performed by the liquid sending unit, wherein the control unit controls the liquid sending unit to stop the liquid sending operation and controls the flow path opening/closing valve to open the fourth flow path when a detection temperature detected by the temperature detecting unit is greater than or equal to a predetermined temperature that is determined in advance, and controls the liquid sending unit to perform the liquid sending operation and controls the flow path opening/closing valve to close the fourth flow path when the detection temperature detected by the temperature detecting unit is less than the predetermined temperature, and the recording head is located at a higher position than that of the liquid tank, and the liquid flows to the recording head from the liquid tank via the pressure adjustment valve when the liquid droplets are jetted from the recording head.

According to an aspect of the present invention, there is provided an image forming apparatus including a recording head including a nozzle that jets liquid droplets; a liquid tank that retains liquid to be supplied to the recording head; a first flow path through which the liquid is supplied to the recording head; a second flow path connected to the liquid tank; a pressure adjustment valve connecting the first flow path with the second flow path, wherein a flow path resistance inside the pressure adjustment valve changes in accordance with a flow rate of the liquid flowing through the first flow path; a third flow path connecting the second flow path or the liquid tank with the pressure adjustment valve; a liquid sending unit that performs a liquid sending operation, the liquid sending unit being provided in the third flow path; a fourth flow path that connects the recording head with the liquid tank and bypasses the pressure adjustment valve; a flow path opening/closing valve that performs an opening/closing operation for opening and closing the fourth flow path; a liquid jetting amount detecting unit that detects a liquid jetting amount of the liquid droplets jetted from the recording head; and a control unit that controls the opening/closing operation performed by the flow path opening/closing valve and the liquid sending operation performed by the liquid sending unit, wherein the control unit controls the liquid sending unit to perform the liquid sending operation and controls the flow path opening/closing valve to close the fourth flow path when the liquid jetting amount detected by the liquid jetting amount detecting unit is greater than or equal to a predetermined amount that is determined in advance, and controls the liquid sending unit to stop the liquid sending operation and controls the flow path opening/closing valve to open the fourth flow path when the liquid jetting amount detected by the liquid jetting amount detecting unit is less than the predetermined amount, and the recording head is located at a higher position than that of the liquid tank, and the liquid flows to the recording head from the liquid tank via the pressure adjustment valve when the liquid droplets are jetted from the recording head.

According to an aspect of the present invention, there is provided an image forming apparatus including a recording head including a nozzle that jets liquid droplets; a liquid tank that retains liquid to be supplied to the recording head; a first flow path through which the liquid is supplied to the recording head; a second flow path connected to the liquid tank; a pressure adjustment valve connecting the first flow path with the second flow path, wherein a flow path resistance inside the pressure adjustment valve changes in accordance with a flow rate of the liquid flowing through the first flow path; a third flow path connecting the second flow path or the liquid tank with the pressure adjustment valve; a liquid sending unit that performs a liquid sending operation, the liquid sending unit being provided in the third flow path; a fourth flow path that connects the recording head with the liquid tank and bypasses the pressure adjustment valve; a flow path opening/closing valve that performs an opening/closing operation for opening and closing the fourth flow path; a position detecting unit that detects a position of a movable member accommodated inside the pressure adjustment valve in such a manner as to move freely; and a control unit that controls the opening/closing operation performed by the flow path opening/closing valve and the liquid sending operation performed by the liquid sending unit, wherein the control unit controls the liquid sending unit to perform the liquid sending operation and controls the flow path opening/closing valve to close the fourth flow path when the position of the movable member detected by the position detecting unit is closer to the first flow path than a predetermined position that is determined in advance, and controls the liquid sending unit to stop the liquid sending operation and controls the flow path opening/closing valve to open the fourth flow path when the position of the movable member detected by the position detecting unit is closer to the second flow path than is the predetermined position, and the recording head is located at a higher position than that of the liquid tank, and the liquid flows to the recording head from the liquid tank via the pressure adjustment valve when the liquid droplets are jetted from the recording head.

According to one embodiment of the present invention, an image forming apparatus is provided, in which an appropriate level of negative pressure can be maintained without causing refill failures and energy efficiency can be increased by driving the liquid sending unit in an efficient manner, with a simple structure and simple control operations.

BRIEF DESCRIPTION OF THE DRAWINGS

Other objects, features and advantages of the present invention will become more apparent from the following detailed description when read in conjunction with the accompanying drawings, in which:

FIG. 8 is a flowchart for describing a printing operation controlled by the control unit;

FIG. 11 is a flowchart for describing a printing operation according to a second embodiment of the present invention;

DETAILED DESCRIPTION OF THE PREFERRED EMBODIMENTS

A description is given, with reference to the accompanying drawings, of embodiments of the present invention.

Figure 1:
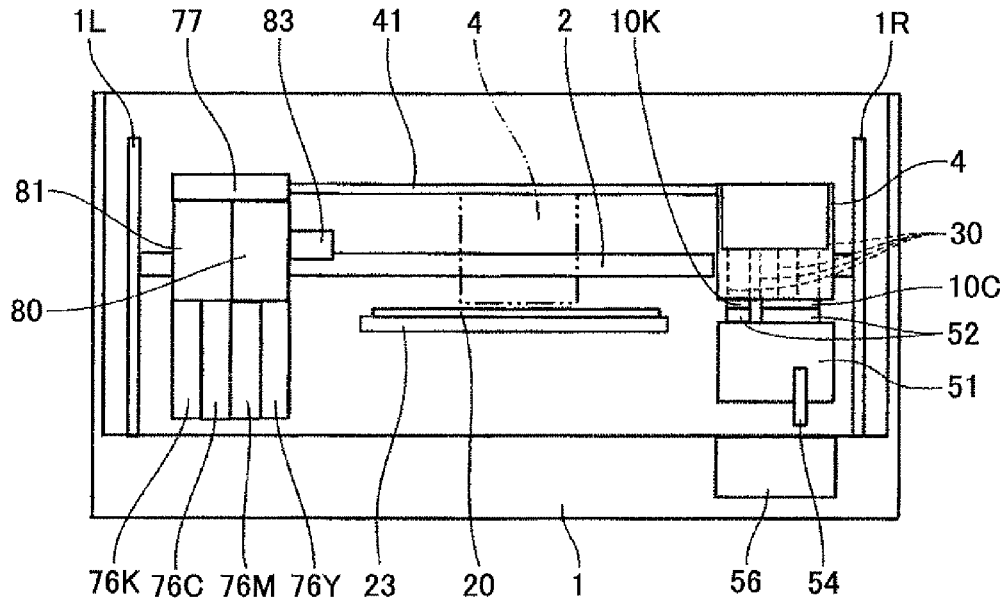
FIG. 1 is a schematic front view of an inkjet recording device as an image forming apparatus according to an embodiment of the present invention.
Figure 2:
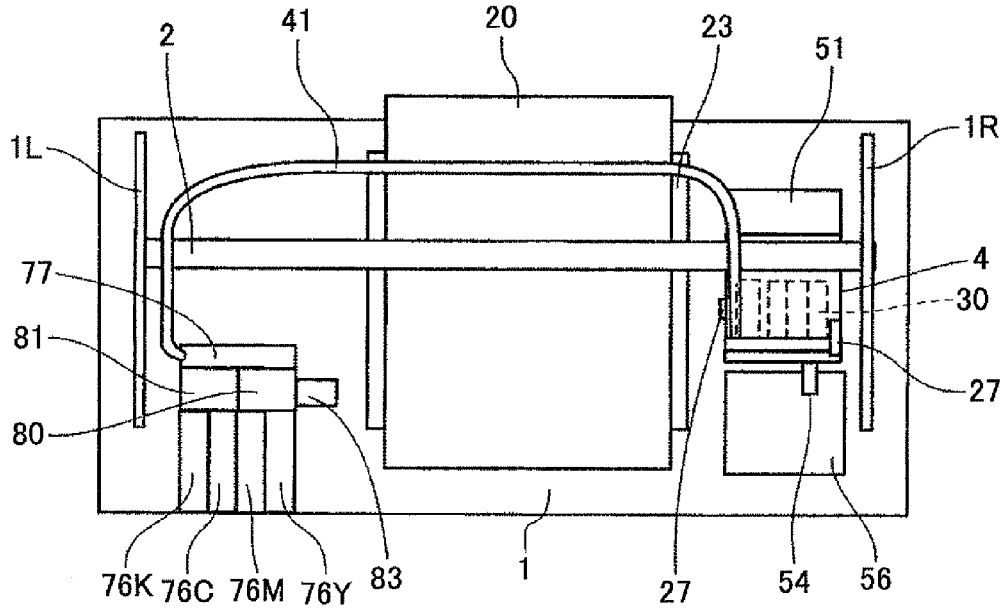
FIG. 2 is a schematic plan view of the inkjet recording device shown in FIG. 1.
Figure 3:
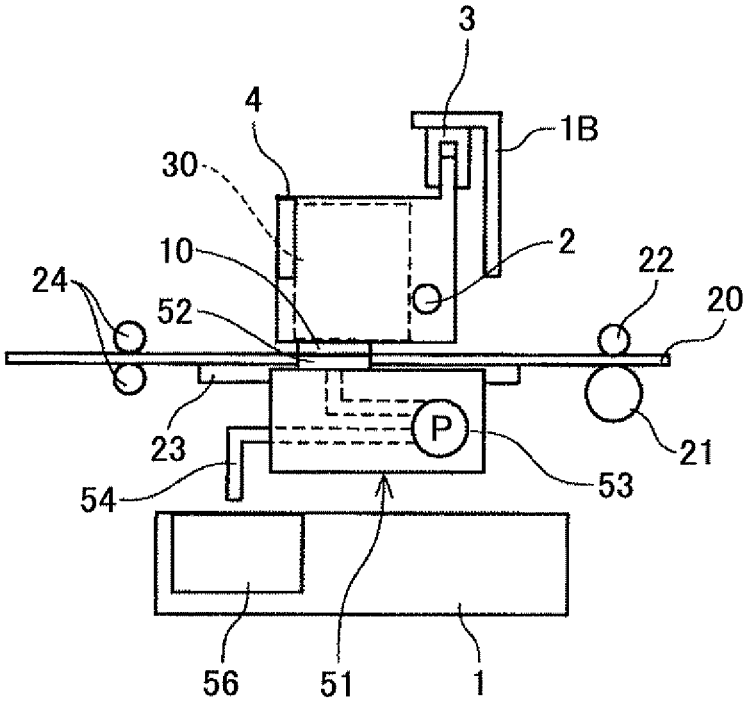
FIG. 3 is a schematic side view of the inkjet recording device shown in FIG. 1.

A description is given of an inkjet recording device as an image forming apparatus according to an embodiment of the present invention, with reference to FIGS. 1 through 3. FIG. 1 is a schematic front view of the inkjet recording device. FIG. 2 is a schematic plan view of the inkjet recording device. FIG. 3 is a schematic side view of the inkjet recording device.

The inkjet recording device includes a left side plate 1L and a right side plate 1R that are standing on a main unit frame 1; a guide rod 2 that is a guide member laterally bridged between the left side plate 1L and the right side plate 1R; and a guide rail 3 that is attached to a back frame 1B that is laterally laid across the main unit frame 1. A carriage 4 is slidably held by these elements, so as to slide in the main scanning direction (longitudinal direction of the guide rod 2). The carriage 4 is moved in a longitudinal direction of the guide rod 2 (main scanning direction) by a main scanning motor and a timing belt, which are not shown.

The carriage 4 is provided with, for example, a recording head 10K that includes a liquid jetting head for jetting black (K) ink droplets, and a recording head 10C that includes liquid jetting heads for jetting cyan (C) ink droplets, magenta (M) ink droplets, and yellow (Y) ink droplets. The recording heads 10K and 10C are arranged such that plural ink jetting outlets (nozzles) are aligned in a direction intersecting the main scanning direction and the ink droplet jetting direction is downward. The recording head 10C includes at least three separate nozzle rows for jetting the respective ink droplets of C, M, and Y. In the following description, the recording head 10K and the nozzle rows corresponding to C, M, and Y in the recording head 10C are collectively referred to as the "recording head 10", unless otherwise noted.

Figure 4:
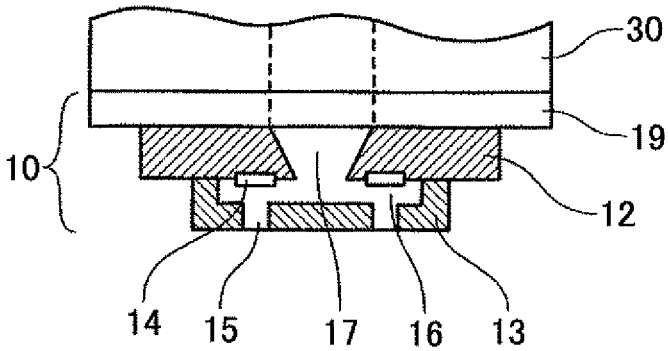
FIG. 4 is an enlarged view of relevant parts of a recording head of the inkjet recording device shown in FIG. 1.

As shown in FIG. 4, the recording head 10 includes a heating element substrate 12 and a liquid chamber forming member 13. Ink is sequentially supplied from a flow path formed in a head base member 19 to a common flow path 17 and a liquid chamber (individual flow path) 16, and the ink is jetted from the recording head 10 as liquid droplets. The recording head 10 is a thermal type, in which jetting pressure is achieved as a result of driving a heating element 14 so that film boiling is caused in the ink. Furthermore, the recording head 10 is a side shooter type, in which the direction of the ink flowing toward the jetting energy function unit (heating element unit) in the liquid chamber 16 and the opening center axis of a nozzle 15 are perpendicular to each other.

There are various types of recording heads. In one example, an oscillating plate is deformed with the use of a piezoelectric element to achieve jetting pressure. In another example, an oscillating plate is deformed with the use of electrostatic force to achieve jetting pressure. Any of these types of recording heads may be applied to the image forming apparatus according to an embodiment of the present invention.

Among thermal type recording heads, there is an edge shooter type with a different jetting direction. The edge shooter type has the problem of the cavitation phenomenon. Specifically, the heating element 14 is gradually damaged due to the shock caused when air bubbles break. Meanwhile, in the side shooter type, the air bubbles grow, and when the air bubbles reach the nozzle 15, the air bubbles are connected to the atmosphere. Accordingly, the air bubbles do not shrink due to a temperature decrease. Consequently, the recording head of the side shooter type has a long service life. Furthermore, the side shooter type is advantageous in that the energy from the heating element 14 is efficiently converted into motion energy for forming ink droplets and for causing the ink droplets to fly. Furthermore, the meniscus is quickly recovered when supplying ink. Therefore, the inkjet recording device according to an embodiment of the present invention includes the side shooter type recording head.

Meanwhile, under the carriage 4, a sheet 20 on which an image is formed by the recording head 10 is conveyed in the main scanning direction and the orthogonal direction (sub scanning direction). As shown in FIG. 3, the sheet 20 is sandwiched by a conveying roller 21 and a holding roller 22 and conveyed toward an image forming area (printing unit) of the recording head 10, conveyed on a print guide member 23, and conveyed in a sheet eject direction by a pair of sheet eject rollers 24.

The scanning operation of the carriage 4 in the main scanning direction and the operation of jetting ink from the recording head 10 are synchronized at appropriate timings based on image data, and an image corresponding to one band is formed on the sheet 20. When an image corresponding to one band is formed on the sheet 20, the sheet 20 is conveyed in the sub scanning direction by a predetermined amount, and then the same recording operation is performed once again to form another image corresponding to one band. The above operations are repeated to form an image corresponding to one page.

Meanwhile, sub tanks 30 (also referred to as buffer tanks or head tanks) are integrally connected to the top of the recording head 10. The sub tanks 30 include ink chambers for temporarily retaining the ink to be jetted. In this description, "integrally connected" also means that the recording head 10 and the sub tanks 30 are connected by tubes, etc., and that they are both installed in the carriage 4.

The ink of the respective colors is supplied to the sub tanks 30 as follows. Ink cartridges (main tanks) 76 (76K, 76C, 76M, and 76Y) are liquid tanks accommodating the ink of the respective colors. The ink cartridges 76 are removably attached to a cartridge holder 77 provided on one end of the inkjet recording device in the main scanning direction. The ink is supplied from these ink cartridges 76 to the sub tanks 30 via a first flow path (liquid supply tube) 41. The first flow path 41 is a tube member forming a part of the ink supply path.

Elements connected to the cartridge holder 77 include not only the ink cartridges 76 but also a pump unit 80 and a pressure control unit 81.

Figure 5:
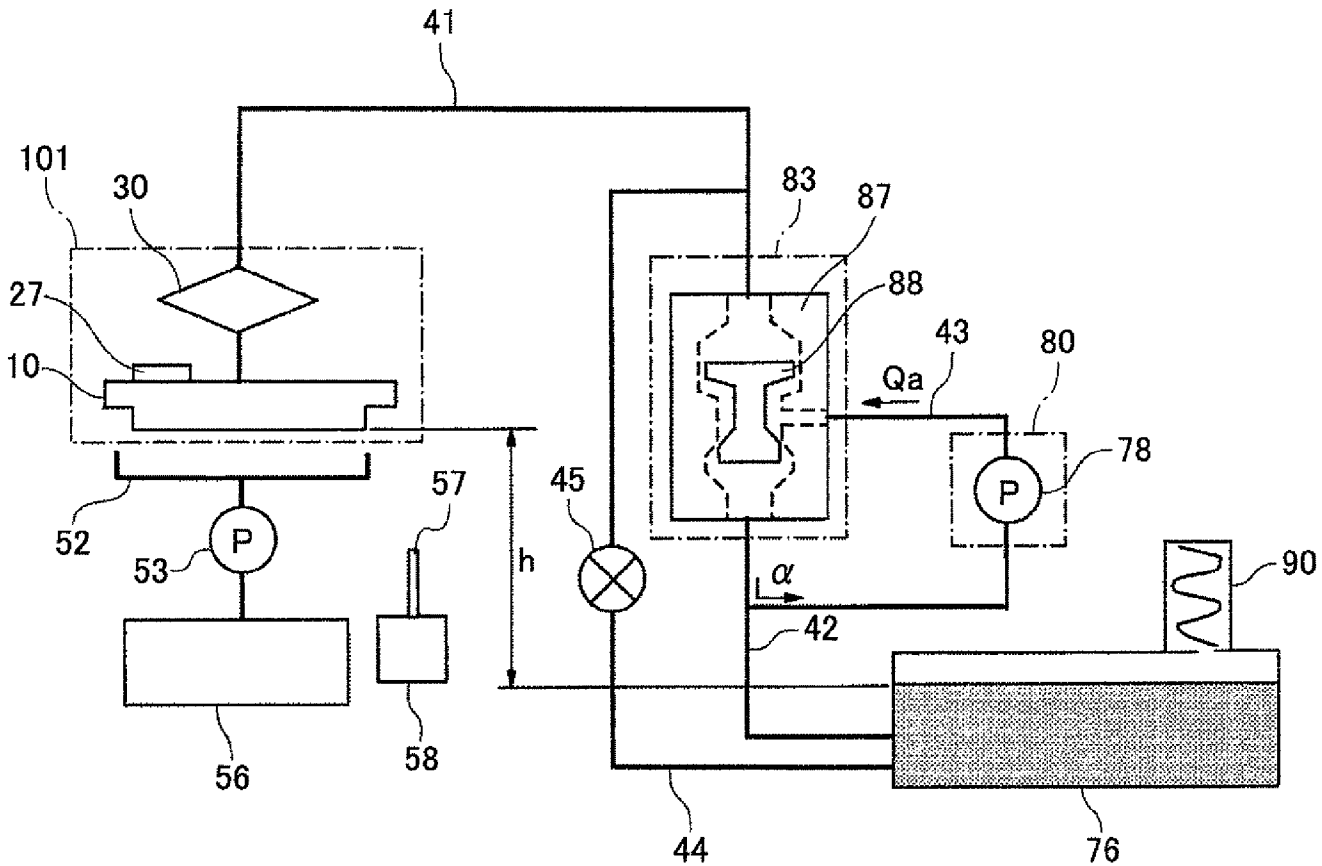
FIG. 5 illustrates an ink supplying system according to a first embodiment of the present invention to which the inkjet recording device is applied.

A maintenance recovery mechanism 51 is provided on the other end of the inkjet recording device in the main scanning direction, for performing maintenance and recovery of the recording head 10. Specifically, the maintenance recovery mechanism 51 includes caps 52 including suction and moisture retention caps and moisture retention caps for capping the nozzle surfaces of the recording head 10. Furthermore, the maintenance recovery mechanism 51 includes a suction pump 53 that suctions ink inside the moisture retention caps, and a discharge path 54 for discharging waste liquid (waste ink) that has been suctioned by the suction pump 53. The waste liquid is discharged through the discharge path 54 into a waste liquid tank 56 that is positioned in the main unit frame 1. The maintenance recovery mechanism 51 includes a moving mechanism (not shown) that causes the caps 52 to move back and forth (up and down in this example) with respect to the nozzle surfaces of the recording head 10. As shown in FIG. 5, the maintenance recovery mechanism 51 includes a wiper member 57 for wiping the nozzle surfaces of the recording head 10. The wiper member 57 is held by a wiping unit 58 so as to move back and forth with respect to the nozzle surfaces of the recording head 10.

Next, with reference to FIG. 5, a description is given of an ink supplying system according to a first embodiment of the present invention to which the above-described inkjet recording device is applied. FIG. 5 schematically illustrates the overall configuration of the ink supplying system. For the purpose of clearly describing the operations and functions of the ink supplying system, FIG. 5 only shows the main elements that are connected to one liquid jetting head (recording head) 10.

The ink supply system includes the ink cartridge 76 for retaining the ink to be supplied to the recording head 10; the first flow path 41 for supplying ink to the recording head 10; a second flow path 42 that is connected to the ink cartridge 76; a flow path resistance variation unit 83 that is a pressure adjusting valve through which the first flow path 41 and the second flow path 42 are connected; a third flow path 43 through which the second flow path 42 and the flow path resistance variation unit 83 are connected; a pump 78 that is a liquid sending unit provided in the third flow path 43 for performing a liquid sending operation; a fourth flow path 44 that connects the recording head 10 and the ink cartridge 76 while bypassing the flow path resistance variation unit (pressure adjusting valve) 83; and an opening/closing valve 45 that is a flow path opening/closing unit for opening/closing the fourth flow path 44.

In this example, the recording head 10 and the sub tank 30 are combined as a single unit, forming a recording head unit 101. The fourth flow path 44 is connected to the first flow path 41 and the ink cartridge 76. The pump 78 is included inside the pump unit 80, and the flow path resistance variation unit 83 is included in the pressure control unit 81.

Figure 6B:
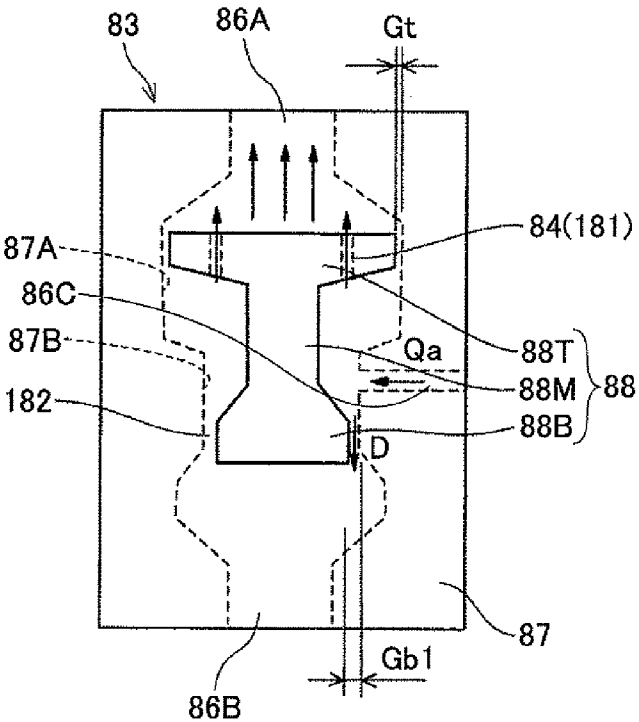
FIGS. 6A and 6B illustrate a flow path resistance variation unit in the ink supplying system.
Figure 6A:
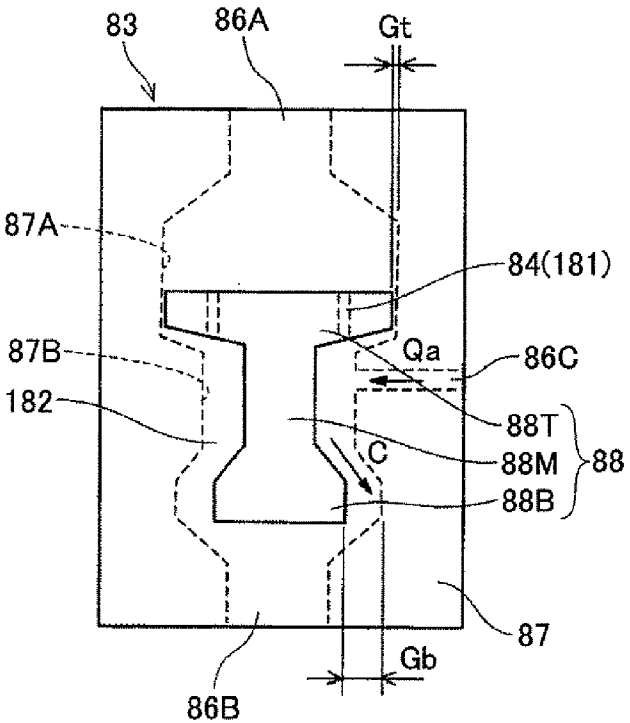

The flow path resistance variation unit 83 has a property of changing the flow path resistance according to the flow direction and the flow rate of liquid flowing through the flow path resistance variation unit 83. As shown in the example of FIGS. 6A and 6B, the flow path resistance variation unit 83 includes a tube member (housing) 87 that is a flow path member, and a valve 88 that is a movable member accommodated inside the flow path of the tube member 87 in such a manner as to move freely.

The tube member 87 includes a port 86A for connecting to the first flow path 41, a port 86B for connecting to the second flow path 42, and a port 86C for connecting to the third flow path 43. The valve 88 is a shaft-like member having stages of different diameters along the flow direction of the liquid. The valve 88 includes at least three stage elements, i.e., a top part 88T, a middle part 88M, and a bottom part 88B. The diameter of the middle part 88M is smaller than that of the bottom part 88B. The valve 88 is movable inside the tube member 87, and moves among the position illustrated in FIG. 6A, the position illustrated in FIG. 6B, and a position between these positions, according to the state of the flow inside the tube member 87.

The top part 88T of the valve 88 includes through holes 84 corresponding to a first diaphragm part 181 in a direction along the ink flow direction, which also serves as a connection path connecting the first flow path 41 and the third flow path 43. A second diaphragm part 182 is formed between a bottom part 88B of the valve 88 and a flow path part 87B of the tube member 87. As the valve 88 moves in accordance with the state of the flow inside as described above, the extent to which the second diaphragm part 182 is opened changes.

The tube member 87 has a horizontal hole (port) 86C that is part of the third flow path 43. The horizontal hole 86C is positioned at the middle part 88M of the valve 88, i.e., between the first diaphragm part 181 and a second diaphragm part 182.

Referring back to FIG. 5, an atmosphere connection part 90 is provided inside the ink cartridge 76. The atmosphere connection part 90 has a small diameter and a snake-like shape, for preventing ink from drying. The ink cartridge 76 is positioned such that there is a water head difference, i.e., such that the liquid surface of the ink cartridge 76 is lower than the nozzle surface in the recording head 10. Accordingly, when all of the ink supply paths are filled with ink, the recording head 10 is maintained at negative pressure according to a water head difference h between the nozzle surface of the recording head 10 and the liquid surface of the ink cartridge 76. Therefore, ink can be stably jetted from the recording head 10.

A description is given of the assist principle when the liquid sending unit of the present ink supplying system is used, with reference to FIGS. 6A and 6B.

FIG. 6A illustrates the state of the flow path resistance variation unit 83 when liquid is not jetted from the recording head 10, or when the amount of liquid jetted from the recording head 10 is small. In this state, the valve 88 is positioned close to the port 86B. As shown in FIG. 6A, when liquid is not jetted from the recording head 10, the ink, which is sent along a direction indicated by an arrow Qa by the pump 78, does not flow toward the port 86A, and thus flows toward the port 86B (in a direction indicated by an arrow C). Similarly, when the amount of liquid jetted from the recording head 10 is small, the ink, which is sent along the direction indicated by the arrow Qa by the pump 78, tends to flow toward the port 86B (in a direction indicated by an arrow C). This is because the total fluid resistance of the through holes 84 corresponding to the first diaphragm part 181, a top gap Gt between the tube member 87 and the top part 88T of the valve 88, the first flow path 41 extending beyond the port 86A, and a filter (not shown) of the recording head 10, is higher than the total fluid resistance on the port 86B side including a bottom gap Gb between the tube member 87 and the lower part of the valve 88. Therefore, the ink flow generated by the pump 78 merely circulates (in a direction indicated by an arrow $\alpha$ in FIG. 5) in the loop path formed by the pump unit 80 and the flow path resistance variation unit 83 illustrated in FIG. 5. Thus, when no pressure is applied to the recording head 10, i.e., when the amount of ink jetted from the recording head 10 is small or when there is no ink jetted from the recording head 10, the valve 88 moves toward the port 86B. Accordingly, the ink flow from the pump unit 80 can be directed toward the port 86B.

Meanwhile, FIG. 6B illustrates the state of the flow path resistance variation unit 83 when a large amount of liquid is jetted from the recording head 10. The gap Gt between the tube member 87 and the top part 88T of the valve 88 is narrow. The ink passes through the through holes 84 which are the first diaphragm part 181, in a direction indicated by an arrow Qh, and is jetted from the recording head 10. The valve 88 receives a force from the flow of this ink, and is attracted toward the port 86A (first flow path), and moves toward the top direction as viewed in FIG. 6B. Accordingly, the bottom part 88B of the valve 88 moves toward the small diameter part (the flow path part 87B: the second diaphragm part 182) of the tube member 87. Thus, a narrow gap Gb1 is formed between the tube member 87 and the bottom part 88B of the valve 88. The ink that is sent in a direction indicated by an arrow Qa by the pump 78 flows through this narrow gap Gb1 (as indicated by an arrow D), and therefore pressure is generated. This pressure reduces the pressure loss that occurs when the ink flows to the recording head 10, and therefore a large amount of ink can be supplied.

That is to say, most of the ink that has received pressure from the pump 78 flows toward the recording head 10, and therefore the pressure loss caused when ink flows is reduced. By repeating the states as illustrated in FIGS. 6A and 6B, an appropriate flow rate and appropriate pressure can be applied to the recording head 10 over a long period of time in the ink supplying system.

In the ink supplying system, the operation of controlling the pump is the same regardless of the flow rate of ink jetted from the recording head 10, even when there are plural types of ink such as yellow (Y), cyan (C), magenta (M), and black (K).

Figure 7:
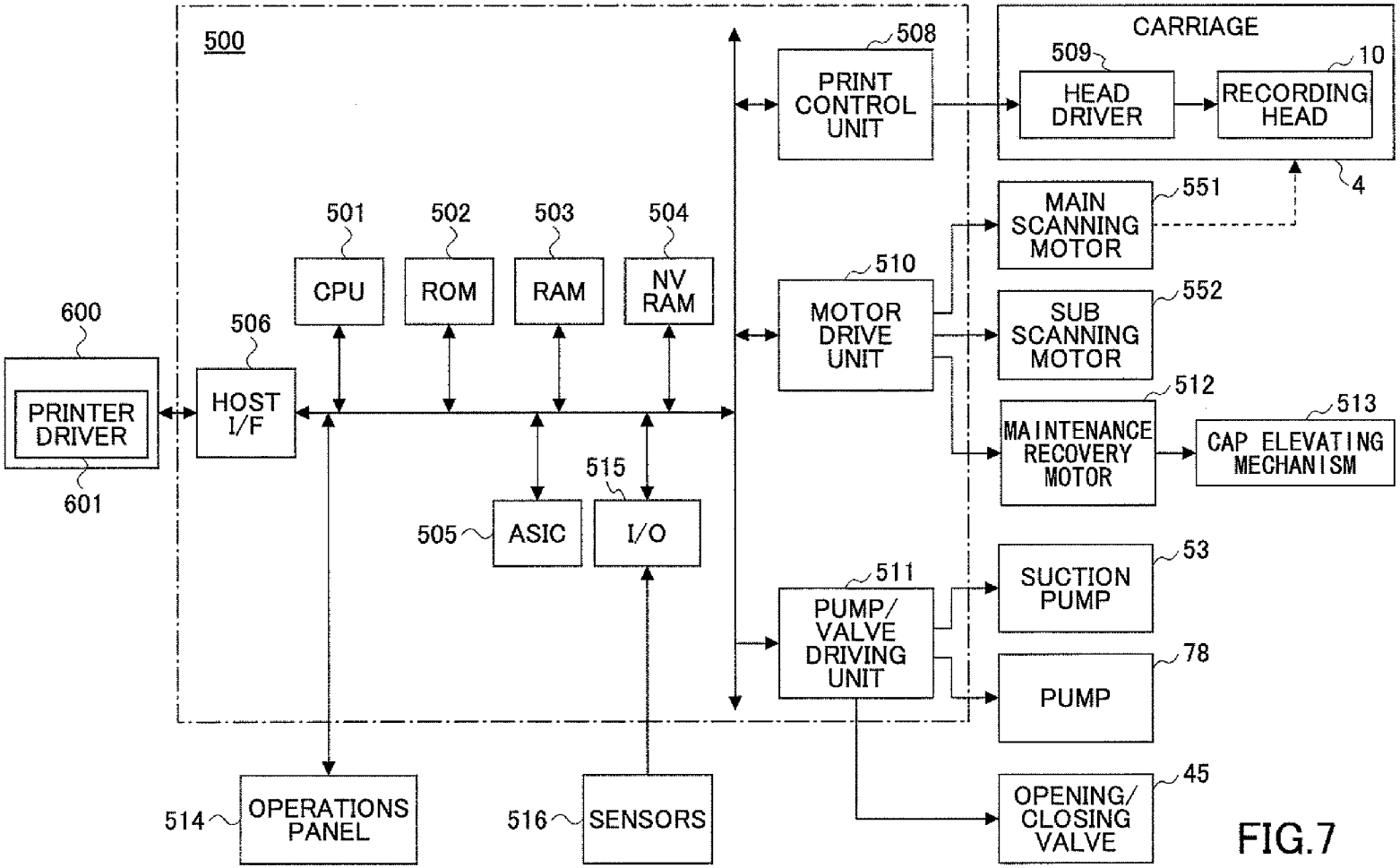
FIG. 7 is a block diagram of a control unit of the image forming apparatus.

Next, a brief description is given of a control unit of the image forming apparatus, with reference to FIG. 7. FIG. 7 is a block diagram of the control unit of the image forming apparatus.

A control unit 500 includes a CPU 501 that controls assistance operations for controlling the entire image forming apparatus and controls maintenance recovery operations. The control unit 500 includes a ROM 502 that stores programs executed by the CPU 501 and other fixed data. The control unit 500 includes a RAM 503 that temporarily stores image data, etc. The control unit 500 includes a rewritable non-volatile memory 504 that holds data even while the power of the image forming apparatus is turned off. The control unit 500 includes an ASIC 505 that performs various signal processing with respect to image data, image processing such as rearrangement, and other input-output signal processing for controlling the entire image forming apparatus.

The control unit 500 includes a print control unit 508 for driving and controlling the recording head 10 according to print data. The control unit 500 includes a head driver (driver IC) 509 provided on the side of the carriage 4, for driving the recording head 10. The control unit 500 includes a motor driving unit 510 for driving a main scanning motor 551 for moving the carriage 4, a sub scanning motor 552 for rotating the conveying roller 21 that conveys the sheet 20, and a maintenance recovery motor 512 that operates a cap elevating mechanism 513 for moving up and down the caps 52 including the suction and moisture retention caps and the moisture retention caps, and the wiper member 57. The control unit 500 includes a pump/valve driving unit 511 for driving the suction pump 53 of the maintenance recovery mechanism 51 and the pump 78, and also for opening and closing the opening/closing valve 45.

An operations panel 514 is connected to the control unit 500, which is used for inputting and displaying information necessary for the image forming apparatus.

The control unit 500 includes a host I/F 506 for exchanging data and signals with a host 600. Therefore, the control unit 500 can receive data and signals from the host 600 with the host I/F 506 via a cable or a network. The host 600 may be an information processing apparatus such as a personal computer, an image scanning device such as an image scanner, and an image pickup device such as a digital camera.

The CPU 501 of the control unit 500 reads and analyzes print data in a reception buffer included in the host I/F 506, performs image processing and rearranges data at the ASIC 505, and transfers the image data from the print control unit 508 to the head driver 509. Dot pattern data used for outputting images is generated by a printer driver 601 in the host 600.

The print control unit 508 transfers the print data as serial data, and outputs, to the head driver 509, transfer clocks, latch signals, and control signals that are necessary for transferring the print data and determining the transfer. The head driver 509 drives the heating element 14 based on print data corresponding to one line of data that is serially input to the recording head 10.

An I/O unit 515 acquires information from various sensors 516 installed in the image forming apparatus, extracts information necessary for controlling the printer, and uses the extracted information for controlling the print control unit 508 and the motor driving unit 510. The sensors 516 include an optical sensor for detecting the position of a sheet, a thermistor for monitoring the temperature inside the apparatus, a sensor for monitoring the voltage of a charging belt, and an interlock switch for detecting whether the cover is open or closed. Accordingly, the I/O unit 515 can process various sensor information items. As shown in FIG. 5, the I/O unit 515 is used for inputting detection signals from a temperature sensor 27 provided on the recording head 10 for detecting the environmental temperature in the apparatus, and for inputting detection signals from a full-load detection sensor for detecting whether the waste liquid tank 56 is fully loaded.

Next, a description is given of an operation of the above-described ink supplying system when printing is performed, with reference to a flowchart of FIG. 8.

First, when the ink supplying system receives print job signals and a print job is to be executed (Yes in step S81), the caps 52 covering nozzle surfaces of the recording head 10 are separated from the nozzle surfaces (release capping) (step S82), and idle jetting is performed so that a predetermined number of ink droplets are jetted (step S83).

Subsequently, the temperature inside the apparatus is detected by the temperature sensor 27 (step S84), and the ink supplying system determines whether the detected temperature is greater than or equal to a predetermined temperature (threshold) that is determined in advance (step S85).

When the detected temperature is greater than or equal to the predetermined temperature (Yes in step S85), ink is supplied by a water head difference method. When the detected temperature is less than the predetermined temperature (No in step S85), ink is supplied by a pump assist supply method with the use of the pump 78.

That is to say, when the detected temperature is greater than or equal to the predetermined temperature, the opening/closing valve 45 is opened (step S86), and operation of the pump 78 is stopped (step S87). Then, a printing operation is started (step S88). When the printing operation ends (Yes in step S89), the wiper member 57 wipes the nozzle surfaces (step S810). Then, idle jetting is performed (step S811). Finally, the nozzle surfaces of the recording head 10 are capped by the caps 52 (step S812).

When the detected temperature is less than the predetermined temperature (No in step S85), the opening/closing valve 45 is closed (step S813), and the pump 78 is driven (step S814). Then, the printing operation is started (step S815). When the printing operation ends (Yes in step S816), the wiper member 57 wipes the nozzle surfaces (step S817). Then, idle jetting is performed (step S818). Finally, the nozzle surfaces of the recording head 10 are capped by the caps 52 (step S819). Subsequently, the operation of the pump 78 is stopped (step S820).

In either of the above processes, the printing operation is executed until a print end signal is received. However, as long as a print end signal is not received, the temperature is detected with the temperature sensor 27, the ink supply method is selected in accordance with the detected temperature, and printing operations are executed.

That is to say, when the liquid (ink in this example) has low viscosity, the ink can be supplied simply by the water head difference method without any refill failures. In this case, if the pump 78 is constantly driven, the power consumption increases, and therefore the environmental load increases, such that the service life of the motor of the pump 78 is reduced.

In a case where the fourth flow path 44 is not included, the following problem may occur. That is, under conditions where the water head difference method can be used for supplying the ink, if the pump 78 is stopped, pressure loss increases because the flow path resistance variation unit 83 is in the ink supply path and the flow path resistance variation unit 83 itself has high fluid resistance. Consequently, refill failures occur, making it difficult to properly perform the printing operation. Therefore, it is difficult to supply the ink by the water head difference method through the flow path resistance variation unit 83 without driving the pump 78.

Figure 9:
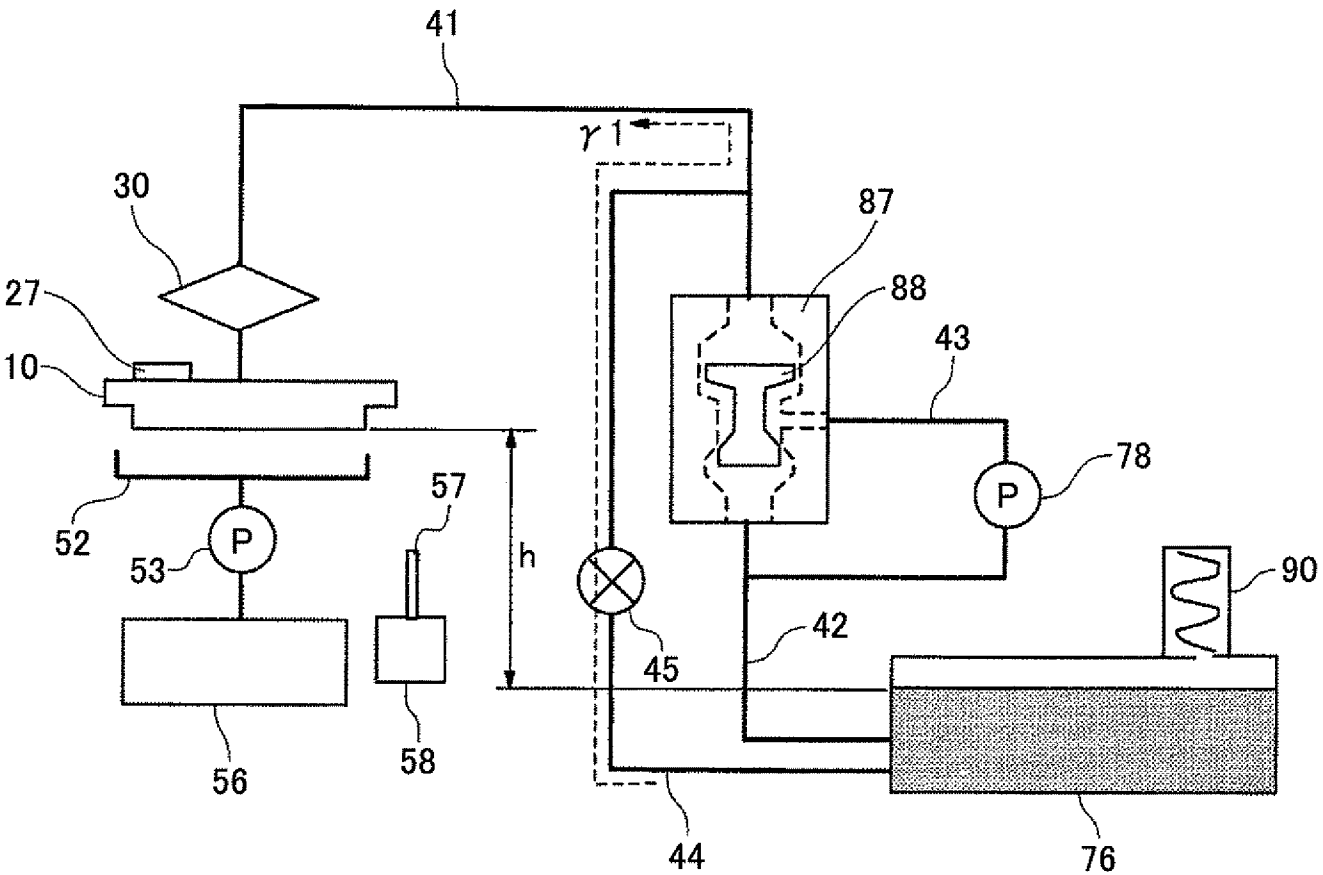
FIG. 9 illustrates an ink flow path when a water head difference method is used in the printing operation described with reference to FIG. 8.
Figure 10:
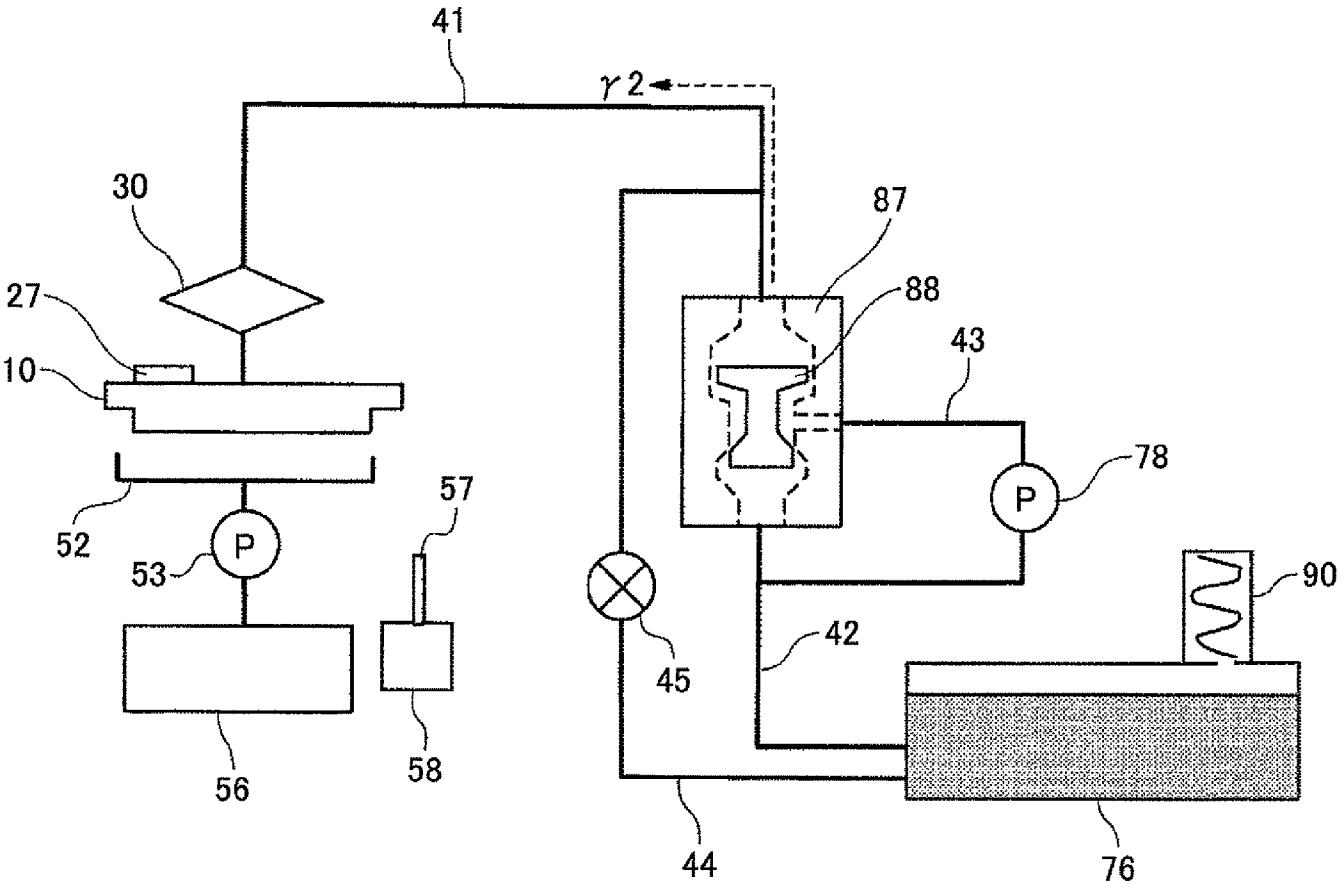
FIG. 10 illustrates an ink flow path when a pump assist supply method is used in the printing operation described with reference to FIG. 8.

However, in an embodiment of the present invention, another path (the fourth flow path 44) that does not run through the flow path resistance variation unit 83 is provided. Therefore, under conditions where the water head difference method can be used for supplying the ink, the pump 78 is not driven, and the opening/closing valve 45 is opened so that the ink is supplied through the other path (the fourth flow path 44) (along a path indicated by an arrow γ1 in FIG. 9). Meanwhile, under conditions where it is difficult to use the water head difference method for supplying the ink, the opening/closing valve 45 of the other path (the fourth flow path 44) is closed, and the pump 78 is driven, so that the ink is supplied along a path indicated by an arrow γ2 in FIG. 10 through the flow path resistance variation unit 83 by assisting the flow of the ink.

As described above, the recording head is located at a higher position than the liquid tank. When jetting liquid droplets from the recording head, the liquid can be sent from the liquid sending unit in a state where the recording head and the liquid tank are connected through the pressure adjustment valve. Furthermore, there is another flow path with a flow path opening/closing valve, through which the recording head and the liquid tank can be connected by bypassing the pressure adjustment valve. When the temperature detected by the temperature detecting unit is greater than or equal to a predetermined temperature that is determined in advance, operation of the liquid sending unit is stopped, and the flow path opening/closing valve is opened so that the liquid is supplied by bypassing the pressure adjustment valve. When the temperature detected by the temperature detecting unit is less than the predetermined temperature, the liquid sending unit is driven, the flow path opening/closing valve is closed, and the liquid is sent from the liquid sending unit. Accordingly, with a simple structure and simple control operations, an appropriate level of negative pressure can be maintained without causing refill failures, and energy efficiency can be increased by driving the liquid sending unit in an efficient manner.

Specifically, the environmental temperature of the apparatus is detected. The viscosity of ink is estimated based on the detected temperature. Based on the estimated viscosity of ink, the method of supplying ink is selectively switched between a water head difference method, and an assist supply method by which the liquid is sent through the pressure adjustment valve using the liquid sending pump (pump assist supply method). Accordingly, power consumption can be reduced, heat is prevented from being generated at the liquid sending pump, and the service life of the liquid sending pump can be increased.

In another example, the ink viscosity may be directly detected with the use of a viscometer, and the method of supplying ink can be switched between the water head difference method and the pump assist supply method based on the detected viscosity.

Furthermore, the threshold used for switching between the water head difference method and the pump assist supply method may be determined based on the ink viscosity at which refill failures occur and the relationship between the temperature in the apparatus and the ink viscosity, or based on results obtained by simulations.

Furthermore, there may be errors between the temperature in the apparatus and the actual temperature of the ink. Therefore, when obtaining the ink viscosity based on the temperature in the apparatus, the estimated viscosity preferably has a plus margin with respect to the threshold used for switching between the water head difference method and the pump assist supply method. That is to say, the estimated viscosity preferably has a sufficient margin with respect to the threshold, so that the pump assist supply method is properly selected under conditions where the water head difference method is difficult, instead of erroneously selecting the water head difference method under such conditions.

Furthermore, the opening/closing valve acting as the flow path opening/closing unit is not particularly limited as long as it is a control valve with which the opening/closing of the flow path can be controlled. Furthermore, the temperature detecting unit is provided in the recording head 10; however, the present invention is not so limited. The temperature detecting unit may be provided anywhere in the image forming apparatus as long as the temperature of the ink can be estimated.

Next, a description is given of an operation of an ink supplying system according a second embodiment of the present invention when printing is performed, with reference to a flowchart of FIG. 11.

The ink supplying system according the second embodiment of the present invention includes a liquid jetting amount detecting unit for detecting the amount of liquid jetted from the recording head 10. The liquid jetting amount detecting unit may be, for example, a unit for detecting the printing duty that is obtained based on image information before printing. In this case, the liquid jetting amount corresponds to the extent of printing duty. However, the liquid jetting amount detecting unit is not limited to the above, as long as the amount of ink to be jetted can be determined before actually jetting the ink.

In the present embodiment, the ink supply method is switched between the water head difference method and the pump assist supply method based on the before-printing detected liquid jetting amount. That is to say, if the detected liquid jetting amount is large, it indicates that a large amount of ink will be jetted from the recording head 10, and a condition in which refill failures tend to occur. Meanwhile, if the detected liquid jetting amount is small, it indicates that a small amount of ink will be jetted from the recording head 10, a condition in which refill failures do not tend to occur even if the refill is delayed. Thus, when the liquid jetting amount is large, the pump 78 is driven when supplying the ink. When the liquid jetting amount is small, the pump 78 is not used, and the ink is supplied by the water head difference method.

The boundary, i.e., the threshold of the liquid jetting amount used for determining whether to supply the ink with the use of the pump 78 can be obtained based on experiments.

Referring to FIG. 11, when the ink supplying system receives print job signals and a print job is to be executed (Yes in step S111), the caps 52 covering the nozzle surfaces of the recording head 10 are separated from the nozzle surfaces (release capping) (step S112), and idle jetting is performed so that a predetermined number of ink droplets are jetted (step S113).

Subsequently, the liquid jetting amount from the recording head 10 is detected with the liquid jetting amount detecting unit (step S114), and the ink supplying system determines whether the detected liquid jetting amount is greater than or equal to a predetermined amount (threshold) that is determined in advance (step S115).

When the detected liquid jetting amount is greater than or equal to the predetermined amount (Yes in step S115), ink is supplied by a pump assist supply method with the use of the pump 78. When the detected liquid jetting amount is not greater than or equal to the predetermined amount (less than the predetermined amount) (No in step S115), ink is supplied by a water head difference method.

When the detected liquid jetting amount is greater than or equal to the predetermined amount (Yes in step S115), the opening/closing valve 45 is closed (step S1113), and the pump 78 is driven (step S1114). Then, the printing operation is started (step S1115). When the printing operation ends (Yes in step S1116), the wiper member 57 wipes the nozzle surfaces (step S1117). Then, idle jetting is performed (step S1118). Finally, the nozzle surfaces of the recording head 10 are capped by the caps 52 (step S1119). Subsequently, the operation of the pump 78 is stopped (step S1120).

When the detected liquid jetting amount is not greater than or equal to the predetermined amount (less than the predetermined amount) (No in step S115), the opening/closing valve 45 is opened (step S116), and operation of the pump 78 is stopped (step S117). Then, a printing operation is started (step S118). When the printing operation ends (Yes in step S119), the wiper member 57 wipes the nozzle surfaces (step S1110). Then, idle jetting is performed (step S1111). Finally, the nozzle surfaces of the recording head 10 are capped by the caps 52 (step S1112).

In either of the above processes, the printing operation is executed until a print end signal is received. However, as long as a print end signal is not received, the liquid jetting amount is detected with the liquid jetting amount detecting unit, the ink supply method is selected in accordance with the detected amount, and printing operations are executed.

As described above, the recording head is located at a higher position than the liquid tank. When jetting liquid droplets from the recording head, the liquid can be sent from the liquid sending unit in a state where the recording head and the liquid tank are connected through the pressure adjustment valve. Furthermore, there is another flow path with a flow path opening/closing valve, through which the recording head and the liquid tank can be connected by bypassing the pressure adjustment valve. When the liquid jetting amount detected by the liquid jetting amount detecting unit is greater than or equal to a predetermined amount that is determined in advance, the liquid sending unit is driven, the flow path opening/closing valve is closed, and the liquid is sent from the liquid sending unit. When the liquid jetting amount detected by the liquid jetting amount detecting unit is less that the predetermined amount, operation of the liquid sending unit is stopped, and the flow path opening/closing valve is opened so that the liquid is supplied by bypassing the pressure adjustment valve. Accordingly, with a simple structure and simple control operations, an appropriate level of negative pressure can be maintained without causing refill failures, and energy efficiency can be increased by driving the liquid sending unit in an efficient manner.

Figure 12:
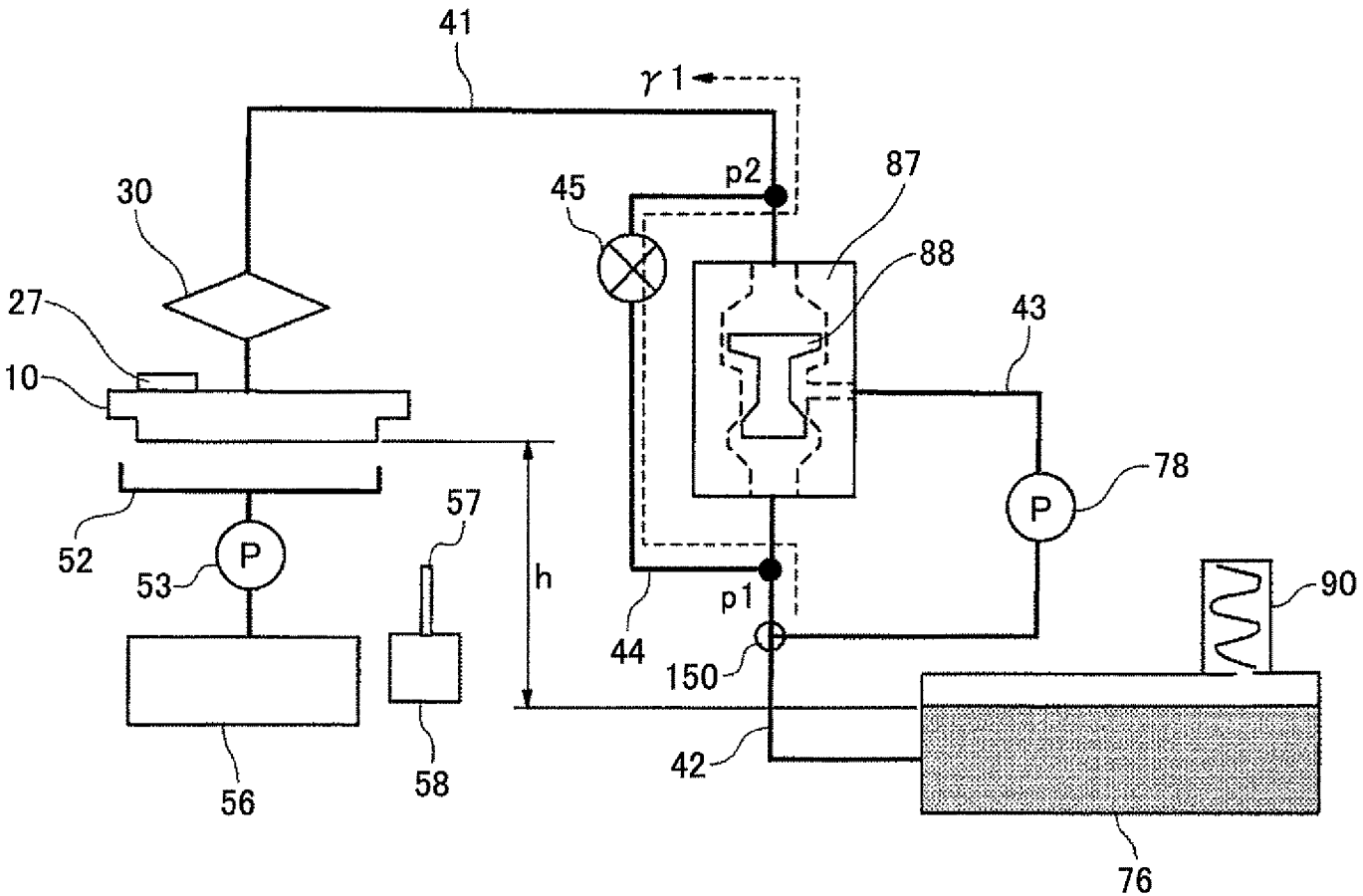
FIG. 12 illustrates an ink supplying system according to a third embodiment of the present invention and an ink flow path when a water head difference method is used in the printing operation.
Figure 13:
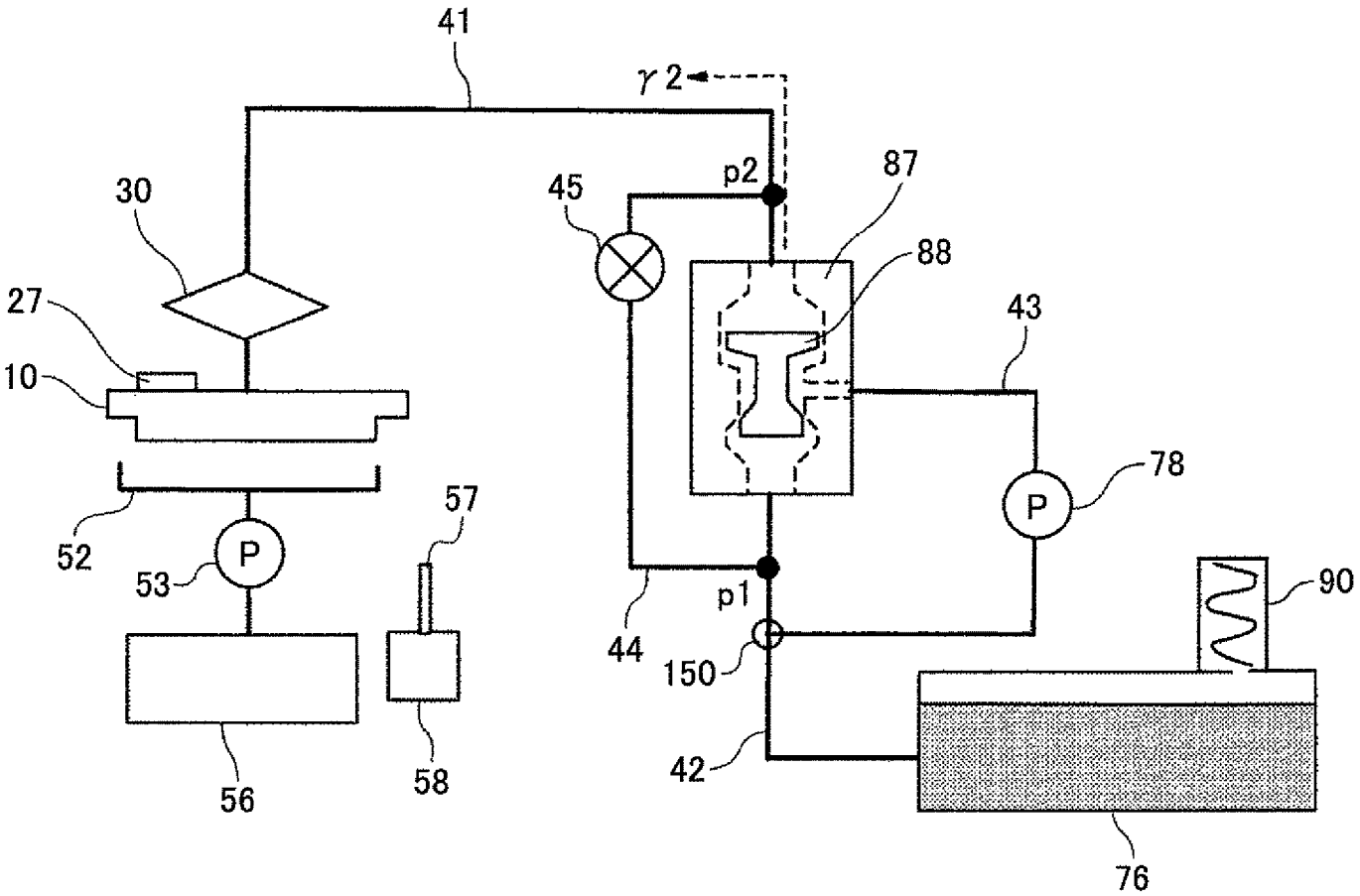
FIG. 13 illustrates an ink flow path when a pump assist supply method is used in the printing operation described with reference to FIG. 12.

Next, a description is given of an ink supplying system according a third embodiment of the present invention with reference to FIGS. 12 and 13.

In the third embodiment, one end of the fourth flow path 44 is connected to a portion p2 of the first flow path 41 close to the flow path resistance variation unit 83 (see FIG. 5), and the other end of the fourth flow path 44 is connected to a portion p1 of the second flow path 42 that is closer to the flow path resistance variation unit 83 than a branch point 150 of the second flow path 42 and the third flow path 43.

In the ink supplying system according to the third embodiment, under conditions where the water head difference method can be used, the pump 78 is not driven, and the opening/closing valve 45 is opened, so that the ink is supplied to the recording head 10 along a path indicated by an arrow γ1 in FIG. 12. Under conditions where it is difficult to use the water head difference method because the temperature is low or the liquid jetting amount is large, the ink is supplied along a path indicated by an arrow γ2 in FIG. 13, so that the ink is supplied to the recording head 10 from the ink cartridge 76 via the flow path resistance variation unit 83. The operation of switching between different ink supply methods may be performed in the same manner as that described in the first and second embodiments.

The third embodiment is advantageous over the first embodiment in that the length of the fourth flow path 44 is reduced, costs of the tube forming the fourth flow path 44 are reduced, restrictions in the layout are reduced, and the number of ports in the ink cartridge 76 is reduced.

Figure 14:
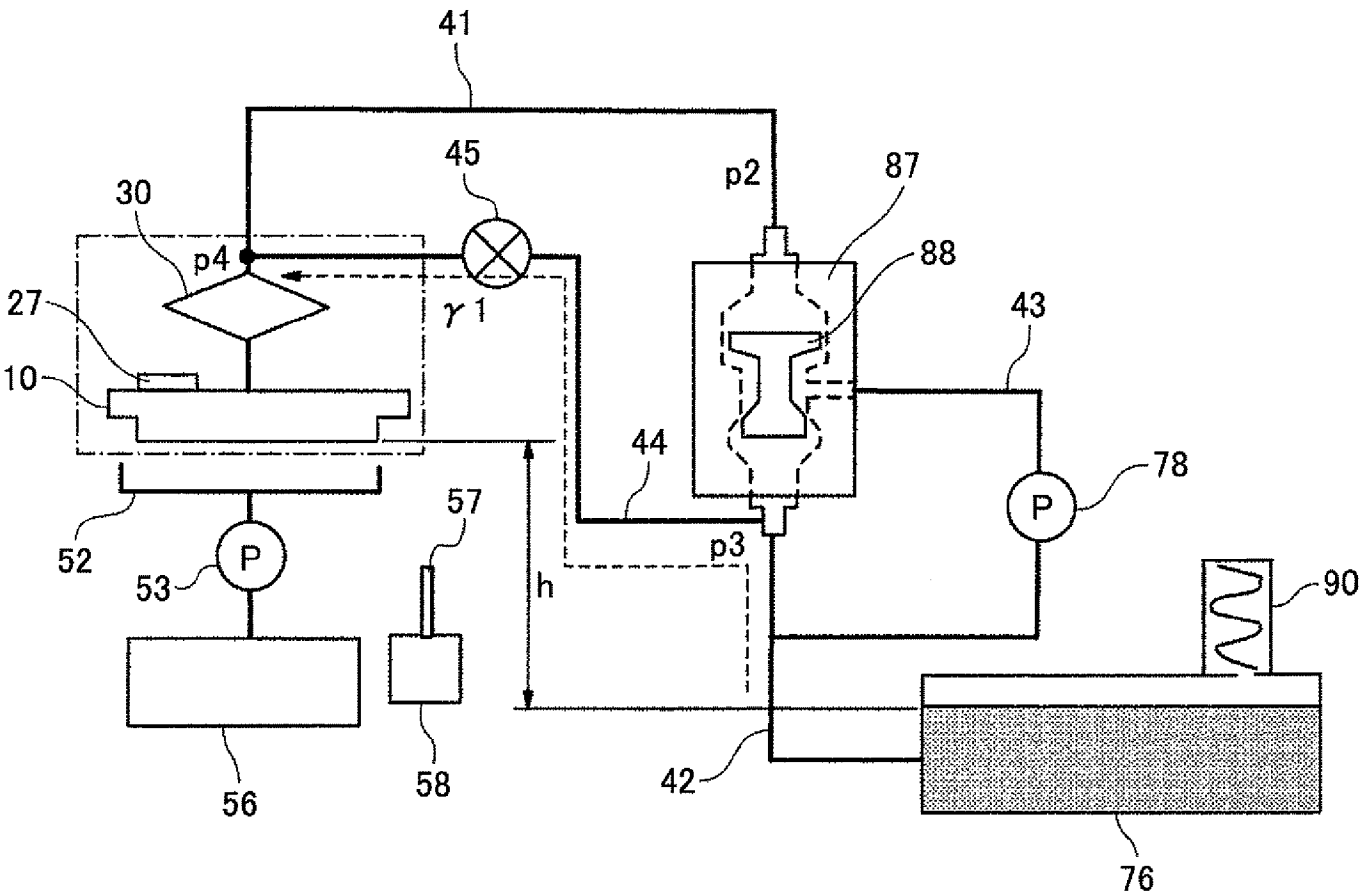
FIG. 14 illustrates an ink supplying system according to a fourth embodiment of the present invention and an ink flow path when a water head difference method is used in the printing operation.
Figure 15:
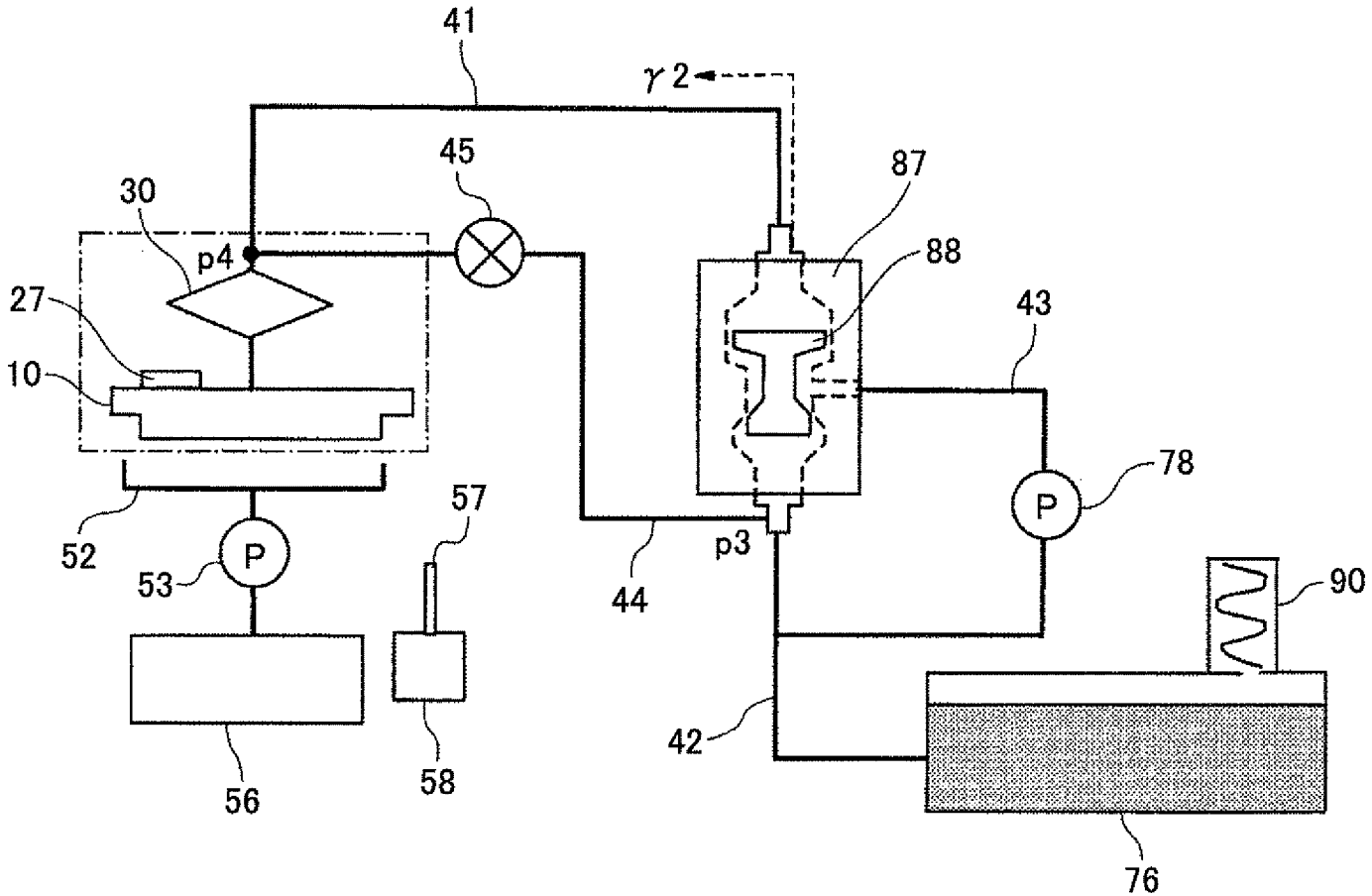
FIG. 15 illustrates an ink flow path when a pump assist supply method is used in the printing operation described with reference to FIG. 14.

Next, a description is given of an ink supplying system according a fourth embodiment of the present invention with reference to FIGS. 14 and 15.

In the fourth embodiment, one end of the fourth flow path 44 is connected to a portion p4 of the first flow path 41 near the ink flow inlet of the sub tank 30, and the other end of the fourth flow path 44 is connected to a portion p3 of the ink flow inlet of the flow path resistance variation unit 83 (see FIG. 5). The portion where the end of the fourth flow path 44 is connected to the first flow path 41 may be at the ink flow inlet of the recording head 10.

In the ink supplying system according to the fourth embodiment, under conditions where the water head difference method can be used, the pump 78 is not driven, and the opening/closing valve 45 is opened, so that the ink is supplied to the recording head 10 along a path indicated by an arrow γ1 in FIG. 14. Under conditions where it is difficult to use the water head difference method because the temperature is low or the liquid jetting amount is large, the ink is supplied along a path indicated by an arrow γ2 in FIG. 15, so that the ink is supplied to the recording head 10 from the ink cartridge 76 via the flow path resistance variation unit 83. The operation of switching between different ink supply methods may be performed in the same manner as that described in the first and second embodiments.

In the fourth embodiment, the recording head 10 and the flow path resistance variation unit 83 are connected by a minimum length. Therefore, the fourth embodiment is advantageous over the above embodiment in that the fluid resistance is low in the tube forming the fourth flow path 44, thus reducing the extent of pressure loss caused when the ink flows through the ink supply tube. In consideration of the water head difference method used for supplying ink, the smaller the pressure loss in the ink supply tube, the wider the temperature range and liquid jetting amount range in which the water head difference method is possible. That is to say, it is possible to increase the temperature range and liquid jetting amount range in which the method using the pump 78 is not performed. Therefore, the power consumption by the pump 78 can be reduced even further, and the service life of the pump 78 can be increased even further.

Figure 16:
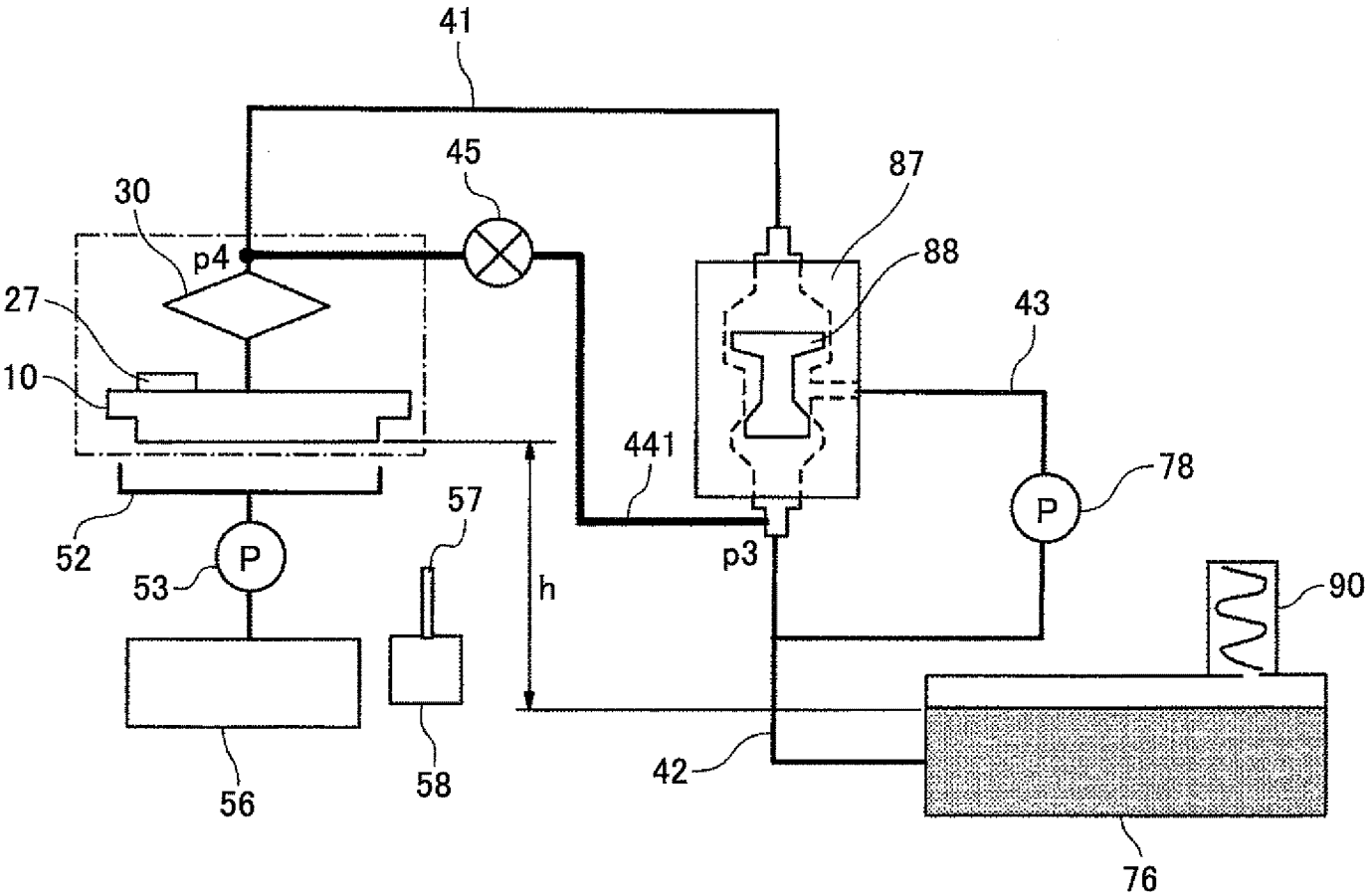
FIG. 16 illustrates an ink supplying system according to a fifth embodiment of the present invention.

Next, a description is given of an ink supplying system according a fifth embodiment of the present invention with reference to FIG. 16.

In the fifth embodiment, a fourth flow path 441 is included instead of the fourth flow path 44 of the fourth embodiment. The fourth flow path 441 is formed by a tube having an internal diameter that is larger than any of those of the tubes forming the first flow path 41 through the third flow path 43.

Accordingly, compared to the fourth embodiment, the pressure loss can be reduced even further and the temperature range and liquid jetting amount range in which the water head difference method is possible can be increased even further in the fifth embodiment. That is to say, it is possible to increase the temperature range and liquid jetting amount range in which the method using the pump 78 is not performed. Therefore, the power consumption by the pump 78 can be reduced even further, and the service life of the pump 78 can be increased even further.

Figure 17:
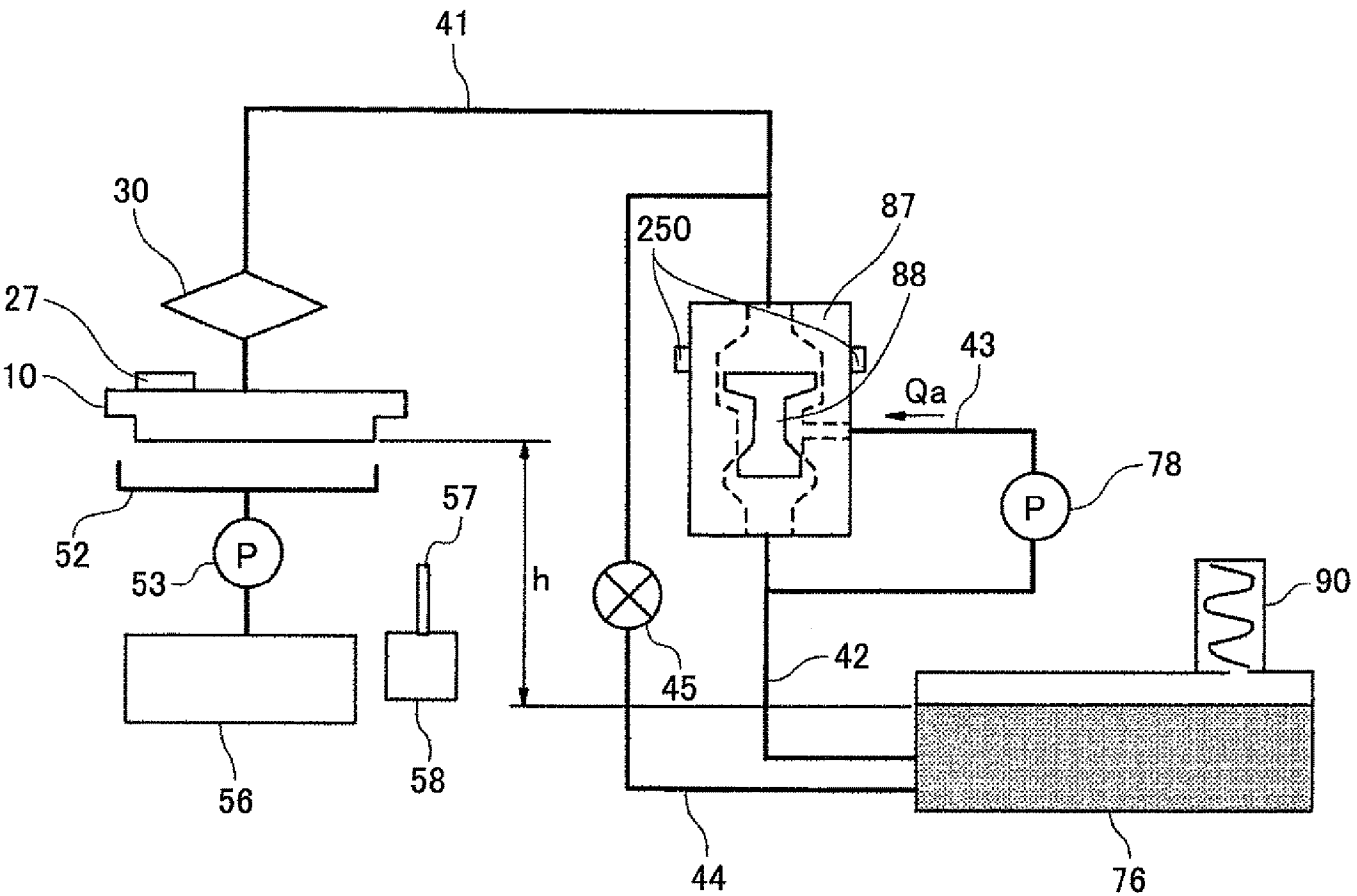
FIG. 17 illustrates an ink supplying system according to a sixth embodiment of the present invention.

Next, a description is given of an ink supplying system according a sixth embodiment of the present invention with reference to FIG. 17.

The sixth embodiment includes a valve position detecting sensor 250 for detecting the position of the valve 88 that is the movable member in the flow path resistance variation unit 83 (see FIG. 5) as described in the first embodiment. The valve position detecting sensor 250 for detecting the position of the valve 88 may be, for example, a photosensor, when the tube member 87 is made of a material that transmits light and the valve 88 is made of a material that transmits less light than the tube member 87. However, the valve position detecting sensor 250 is not particularly limited as long as it can detect variations in the position of the valve 88.

The valve position detecting sensor 250 detects whether the valve 88 has moved toward the first flow path 41 past a predetermined position (threshold).

Figure 18:
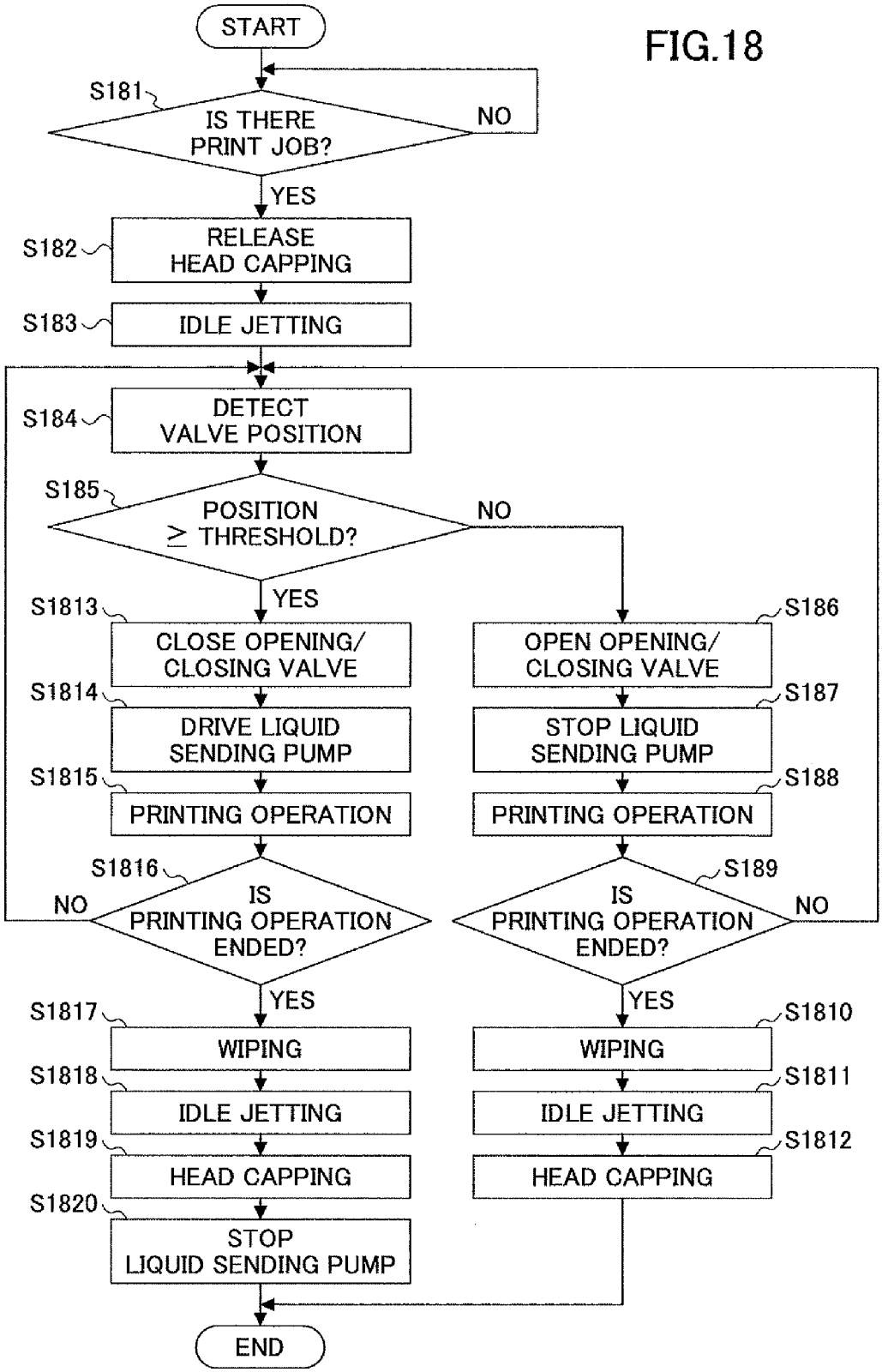
FIG. 18 is a flowchart for describing a printing operation according to the sixth embodiment of the present invention.

Next, a description is given of an operation of the ink supplying system according the sixth embodiment of the present invention when printing is performed, with reference to a flowchart of FIG. 18.

When the ink supplying system receives print job signals and a print job is to be executed (Yes in step S181), the caps 52 covering the nozzle surfaces of the recording head 10 are separated from the nozzle surfaces (release capping) (step S182), and idle jetting is performed so that a predetermined number of ink droplets are jetted (step S183).

Subsequently, the valve position detecting sensor 250 determines whether the position of the valve 88 has moved past a predetermined position that is determined in advance (threshold) (toward the first flow path 41) (step S184).

When the position of the valve 88 has moved past the predetermined position (Yes in step S185), ink is supplied by a pump assist supply method with the use of the pump 78. When the position of the valve 88 has not moved past the predetermined position (closer to the second flow path 42 than the predetermined position) (No in step S185), ink is supplied by a water head difference method.

When the position of the valve 88 has moved past the predetermined position (Yes in step S185), the opening/closing valve 45 is closed (step S1813), and the pump 78 is driven (step S1814). Then, the printing operation is started (step S1815). When the printing operation ends (Yes in step S1816), the wiper member 57 wipes the nozzle surfaces (step S1817). Then, idle jetting is performed (step S1818). Finally, the nozzle surfaces of the recording head 10 are capped by the caps 52 (step S1819). Subsequently, the operation of the pump 78 is stopped (step S1820).

When the position of the valve 88 has not moved past the predetermined position (positioned before the predetermined position) (No in step S185), the opening/closing valve 45 is opened (step S186), and operation of the pump 78 is stopped (step S187). Then, a printing operation is started (step S188). When the printing operation ends (Yes in step S189), the wiper member 57 wipes the nozzle surfaces (step S1810). Then, idle jetting is performed (step S1811). Finally, the nozzle surfaces of the recording head 10 are capped by the caps 52 (step S1812).

In either of the above processes, the printing operation is executed until a print end signal is received. However, as long as a print end signal is not received, the valve position detecting sensor 250 detects the valve position, the ink supply method is selected in accordance with the detected valve position, and printing operations are executed.

Figure 19:
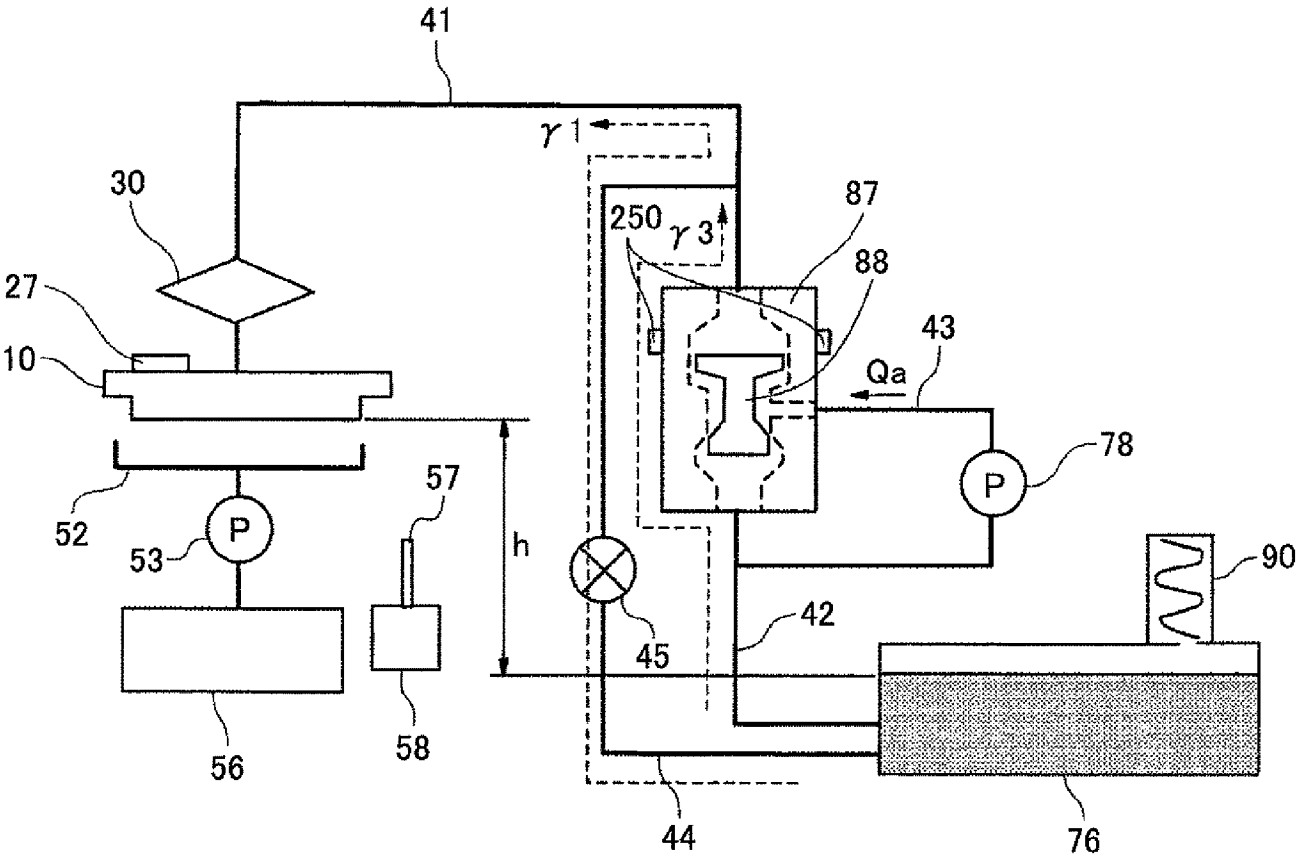
FIG. 19 illustrates an ink flow path when a water head difference method is used in the printing operation described with reference to FIG. 18.
Figure 20:
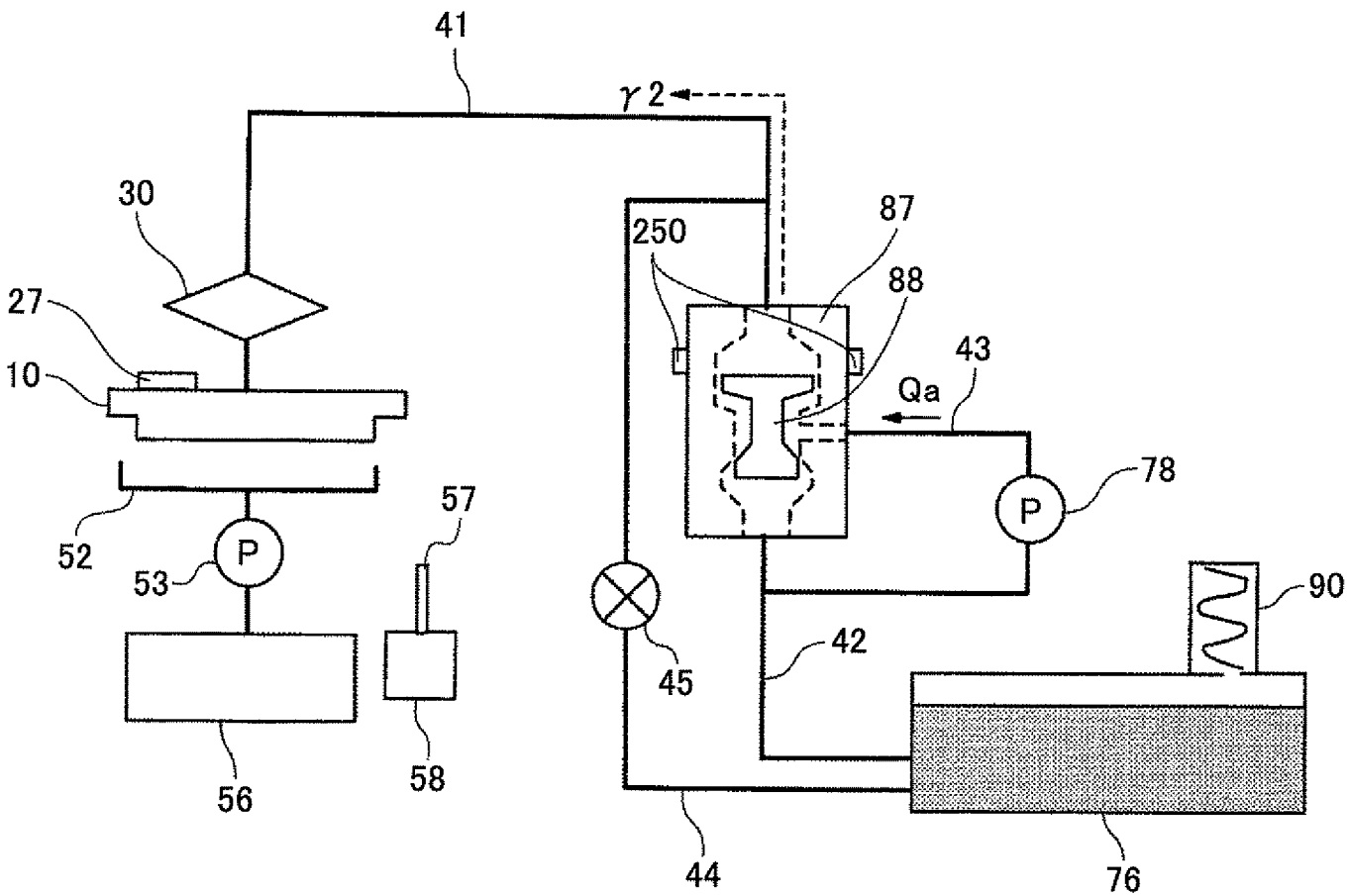
FIG. 20 illustrates an ink flow path when a pump assist supply method is used in the printing operation described with reference to FIG. 19.

In the ink supplying system according to the sixth embodiment, under conditions where the water head difference method can be used without causing refill failures in the recording head 10, the pump 78 is not driven, and the opening/closing valve 45 is opened, so that the ink is supplied to the recording head 10 along a path indicated by an arrow γ1 in FIG. 19 by a simple water head difference method. A slight amount of ink flows into a path indicated by an arrow γ3 extending from the ink cartridges 76, through the flow path resistance variation unit 83, toward the recording head 10. Due to the negative pressure generated at the recording head 10, the valve 88 rises. When the position of the valve 88 rises past a not-shown threshold (predetermined position) T, pressure loss is caused so that the ink is not supplied in time to the recording head 10, and therefore it becomes difficult to perform the water head difference method. In such a situation, the pump 78 is driven and the opening/closing valve 45 is closed, so that ink is supplied along a path indicated by an arrow γ2 in FIG. 20, to the recording head 10 from the ink cartridge 76 via the flow path resistance variation unit 83, by the pump assist supply method.

As described above, the recording head is located at a higher position than the liquid tank. When jetting liquid droplets from the recording head, the liquid can be sent from the liquid sending unit in a state where the recording head and the liquid tank are connected through the pressure adjustment valve. Furthermore, there is another flow path with a flow path opening/closing valve, through which the recording head and the liquid tank can be connected by bypassing the pressure adjustment valve. When the movable member of the pressure adjustment valve is closer to the first flow path from a predetermined position that is determined in advance, the liquid sending unit is driven, the flow path opening/closing valve is closed, and the liquid is sent from the liquid sending unit. When the movable member of the pressure adjustment valve is closer to the second flow path from the predetermined position, operation of the liquid sending unit is stopped, and the flow path opening/closing valve is opened so that the liquid is supplied by bypassing the pressure adjustment valve. Accordingly, with a simple structure and simple control operations, an appropriate level of negative pressure can be maintained without causing refill failures, and energy efficiency can be increased by driving the liquid sending unit in an efficient manner.

In the above description, the operations and effects of the present invention are described by examples in which ink types of different colors are respectively supplied to plural heads; however, the present invention is also applicable to a case where ink of the same color is supplied to the plural heads. Furthermore, the present invention is also applicable to an ink supplying system in which a single liquid jetting head includes plural nozzle rows, and different kinds of liquid are jetted from the single head. Furthermore, the present invention is not limited to an image forming apparatus that jets ink in a limited sense; the preset invention is applicable to various types of liquid jetting apparatuses that jet liquid (including the image forming apparatus).

The present invention is not limited to the specific embodiments described herein, and variations and modifications may be made without departing from the scope of the present invention.

The present application is based on Japanese Priority Patent Application No. 2009-284565, filed on Dec. 15, 2009, the entire contents of which are hereby incorporated herein by reference.

What is claimed is:

1. An image forming apparatus comprising:

a recording head including a nozzle that jets liquid droplets;

a liquid tank that retains liquid to be supplied to the recording head;

a first flow path through which the liquid is supplied to the recording head;

a second flow path connected to the liquid tank;

a pressure adjustment valve connecting the first flow path with the second flow path, wherein a flow path resistance inside the pressure adjustment valve changes in accordance with a flow rate of the liquid flowing through the first flow path;

a third flow path connecting the second flow path or the liquid tank with the pressure adjustment valve;

a liquid sending unit that performs a liquid sending operation, the liquid sending unit being provided in the third flow path;

a fourth flow path that connects the recording head with the liquid tank and bypasses the pressure adjustment valve;

a flow path opening/closing valve that performs an opening/closing operation for opening and closing the fourth flow path;

a temperature detecting unit that detects an environmental temperature of the image forming apparatus; and a control unit that controls the opening/closing operation performed by the flow path opening/closing valve and the liquid sending operation performed by the liquid sending unit, wherein the control unit controls the liquid sending unit to stop the liquid sending operation and controls the flow path opening/closing valve to open the fourth flow path when a detection temperature detected by the temperature detecting unit is greater than or equal to a predetermined temperature that is determined in advance, and controls the liquid sending unit to perform the liquid sending operation and controls the flow path opening/closing valve to close the fourth flow path when the detection temperature detected by the temperature detecting unit is less than the predetermined temperature, and the recording head is located at a higher position than that of the liquid tank, and the liquid flows to the recording head from the liquid tank via the pressure adjusttment valve when the liquid droplets are jetted from the recording head.

2. The image forming apparatus according to claim 1, wherein the fourth flow path is connected to the first flow path and the liquid tank.

3. The image forming apparatus according to claim 1, wherein the fourth flow path is connected to the first flow path and the second flow path.

4. The image forming apparatus according to claim 1, wherein the fourth flow path is connected to the recording head and a liquid flow inlet of the pressure adjustment valve that is connected to the second flow path.

5. The image forming apparatus according to claim 1, wherein the fourth flow path has an internal diameter that is larger than any of those of the first flow path, the second flow path, and the third flow path.

6. An image forming apparatus comprising:

a recording head including a nozzle that jets liquid droplets;

a liquid tank that retains liquid to be supplied to the recording head;

a first flow path through which the liquid is supplied to the recording head;

a second flow path connected to the liquid tank;

a pressure adjustment valve connecting the first flow path with the second flow path, wherein a flow path resistance inside the pressure adjustment valve changes in accordance with a flow rate of the liquid flowing through the first flow path;

a third flow path connecting the second flow path or the liquid tank with the pressure adjustment valve;

a liquid sending unit that performs a liquid sending operation, the liquid sending unit being provided in the third flow path;

a fourth flow path that connects the recording head with the liquid tank and bypasses the pressure adjustment valve;

a flow path opening/closing valve that performs an opening/closing operation for opening and closing the fourth flow path;

a liquid jetting amount detecting unit that detects a liquid jetting amount of the liquid droplets jetted from the recording head; and a control unit that controls the opening/closing operation performed by the flow path opening/closing valve and the liquid sending operation performed by the liquid sending unit, wherein the control unit controls the liquid sending unit to perform the liquid sending operation and controls the flow path opening/closing valve to close the fourth flow path when the liquid jetting amount detected by the liquid jetting amount detecting unit is greater than or equal to a predetermined amount that is determined in advance, and controls the liquid sending unit to stop the liquid sending operation and controls the flow path opening/closing valve to open the fourth flow path when the liquid jetting amount detected by the liquid jetting amount detecting unit is less than the predetermined amount, and the recording head is located at a higher position than that of the liquid tank, and the liquid flows to the recording head from the liquid tank via the pressure adjustment valve when the liquid droplets are jetted from the recording head.

7. An image forming apparatus comprising:

a recording head including a nozzle that jets liquid droplets;

a liquid tank that retains liquid to be supplied to the recording head;

a first flow path through which the liquid is supplied to the recording head;

a second flow path connected to the liquid tank;

a pressure adjustment valve connecting the first flow path with the second flow path, wherein a flow path resistance inside the pressure adjustment valve changes in accordance with a flow rate of the liquid flowing through the first flow path;

a third flow path connecting the second flow path or the liquid tank with the pressure adjustment valve;

a liquid sending unit that performs a liquid sending operation, the liquid sending unit being provided in the third flow path;

a fourth flow path that connects the recording head with the liquid tank and bypasses the pressure adjustment valve;

a flow path opening/closing valve that performs an opening/closing operation for opening and closing the fourth flow path;

a position detecting unit that detects a position of a movable member accommodated inside the pressure adjustment valve in such a manner as to move freely; and a control unit that controls the opening/closing operation performed by the flow path opening/closing valve and the liquid sending operation performed by the liquid sending unit, wherein the control unit controls the liquid sending unit to perform the liquid sending operation and controls the flow path opening/closing valve to close the fourth flow path when the position of the movable member detected by the position detecting unit is closer to the first flow path than a predetermined position that is determined in advance, and controls the liquid sending unit to stop the liquid sending operation and controls the flow path opening/closing valve to open the fourth flow path when the position of the movable member detected by the position detecting unit is closer to the second flow path than is the predetermined position, and the recording head is located at a higher position than that of the liquid tank, and the liquid flows to the recording head from the liquid tank via the pressure adjustment valve when the liquid droplets are jetted from the recording head.

* * * * *